US009017438B1

(12) United States Patent
Miess et al.

(10) Patent No.: US 9,017,438 B1
(45) **Date of Patent: *Apr. 28, 2015**

(54) POLYCRYSTALLINE DIAMOND COMPACT INCLUDING A POLYCRYSTALLINE DIAMOND TABLE WITH A THERMALLY-STABLE REGION HAVING AT LEAST ONE LOW-CARBON-SOLUBILITY MATERIAL AND APPLICATIONS THEREFOR

(75) Inventors: David P. Miess, Highland, UT (US); Michael A. Vail, Genola, UT (US); Kenneth E. Bertagnolli, Riverton, UT (US); C. Eugene McMurray, Payson, UT (US); Paul Douglas Jones, Elk Ridge, UT (US)

(73) Assignee: US Synthetic Corporation, Orem, UT (US)

( * ) Notice: Subject to any disclaimer, the term of this patent is extended or adjusted under 35 U.S.C. 154(b) by 813 days.

This patent is subject to a terminal disclaimer.

(21) Appl. No.: 13/027,954

(22) Filed: Feb. 15, 2011

Related U.S. Application Data

(63) Continuation-in-part of application No. 11/545,929, filed on Oct. 10, 2006, now Pat. No. 8,236,074, and a continuation-in-part of application No. 12/394,356, filed on Feb. 27, 2009, now Pat. No. 8,080,071.

(60) Provisional application No. 61/068,120, filed on Mar. 3, 2008.

(51) Int. Cl.
*B24D 18/00* (2006.01)
*B24D 99/00* (2010.01)
*B24D 3/02* (2006.01)

(52) U.S. Cl.
CPC ..... *B24D 3/02* (2013.01)

(58) Field of Classification Search
CPC ..... B24D 18/00; B24D 99/00
USPC ..... 51/307; 175/434, 433
See application file for complete search history.

(56) References Cited

U.S. PATENT DOCUMENTS 2,349,577 A 5/1944 Dean
3,745,623 A 7/1973 Wentorf, Jr. et al.
(Continued)

FOREIGN PATENT DOCUMENTS

EP 0 297 071 12/1988
EP 0 352 811 1/1990
(Continued)

OTHER PUBLICATIONS

U.S. Appl. No. 13/292,900, filed Nov. 9, 2011, Vail.
(Continued)

*Primary Examiner* — Pegah Parvini
(74) *Attorney, Agent, or Firm* — Dorsey & Whitney LLP

(57) ABSTRACT

Embodiments of the invention relate to polycrystalline diamond compacts ("PDCs") comprising a polycrystalline diamond ("PCD") table including a thermally-stable region having at least one low-carbon-solubility material disposed interstitially between bonded diamond grains thereof, and methods of fabricating such PDCs. In an embodiment, a PDC includes a substrate, and a PCD table bonded to the substrate. The PCD table includes a plurality of diamond grains exhibiting diamond-to-diamond bonding therebetween and defining a plurality of interstitial regions. The PCD table further includes at least one low-carbon-solubility material disposed in at least a portion of the plurality of interstitial regions. The at least one low-carbon-solubility material exhibits a melting temperature of about 1300° C. or less and a bulk modulus at 20° C. of less than about 150 GPa.

28 Claims, 15 Drawing Sheets

(56) References Cited

U.S. PATENT DOCUMENTS 3,918,219 A 11/1975 Wentorf, Jr. et al.
4,009,027 A 2/1977 Naidich et al.
4,016,736 A 4/1977 Carrison et al.
4,063,909 A 12/1977 Mitchell
4,084,942 A 4/1978 Villalobos
4,191,735 A 3/1980 Nelson et al.
4,224,380 A 9/1980 Bovenkerk et al.
4,268,276 A 5/1981 Bovenkerk
4,274,900 A 6/1981 Mueller et al.
4,333,902 A 6/1982 Hara
4,410,054 A 10/1983 Nagel et al.
4,440,573 A 4/1984 Ishizuka
4,460,382 A 7/1984 Ohno
4,468,138 A 8/1984 Nagel
4,560,014 A 12/1985 Geczy
4,676,124 A 6/1987 Fischer
4,692,418 A 9/1987 Boecker et al.
4,738,322 A 4/1988 Hall et al.
4,766,027 A 8/1988 Burn
4,778,486 A 10/1988 Csillag et al.
4,797,326 A 1/1989 Csillag
4,811,801 A 3/1989 Salesky et al.
4,913,247 A 4/1990 Jones
4,940,180 A 7/1990 Martell
4,985,051 A 1/1991 Ringwood
4,992,082 A 2/1991 Drawl et al.
5,011,514 A 4/1991 Cho et al.
5,016,718 A 5/1991 Tandberg
5,032,147 A 7/1991 Frushour
5,049,164 A 9/1991 Horton et al.
5,092,687 A 3/1992 Hall
5,120,327 A 6/1992 Dennis
5,127,923 A 7/1992 Bunting et al.
5,135,061 A 8/1992 Newton, Jr.
5,151,107 A 9/1992 Cho et al.
5,154,245 A 10/1992 Waldenstrom et al.
5,173,091 A 12/1992 Marek
5,180,022 A 1/1993 Brady
5,217,154 A 6/1993 Elwood et al.
5,326,380 A 7/1994 Yao et al.
5,348,109 A 9/1994 Griffin
5,355,969 A 10/1994 Hardy et al.
5,364,192 A 11/1994 Damm et al.
5,368,398 A 11/1994 Damm et al.
5,460,233 A 10/1995 Meany et al.
5,480,233 A 1/1996 Cunningham
5,544,713 A 8/1996 Dennis
5,617,997 A 4/1997 Kobayashi et al.
5,645,617 A 7/1997 Frushour
5,660,075 A 8/1997 Johnson et al.
5,876,859 A 3/1999 Saxelby, Jr. et al.
5,976,707 A 11/1999 Grab
6,054,693 A 4/2000 Barmatz et al.
6,165,616 A 12/2000 Lemelson et al.
6,209,429 B1 4/2001 Urso, III et al.
6,220,375 B1 4/2001 Butcher et al.
6,302,225 B1 10/2001 Yoshida et al.
6,338,754 B1 1/2002 Cannon et al.
6,344,149 B1 2/2002 Oles
6,390,181 B1 5/2002 Hall et al.
6,410,085 B1 6/2002 Griffin et al.
6,435,058 B1 8/2002 Matthias et al.
6,481,511 B2 11/2002 Matthias et al.
6,544,308 B2 4/2003 Griffin et al.
6,562,462 B2 5/2003 Griffin et al.
6,585,064 B2 7/2003 Griffin et al.
6,589,640 B2 7/2003 Griffin et al.
6,592,985 B2 7/2003 Griffin et al.
6,601,662 B2 8/2003 Matthias et al.
6,739,214 B2 5/2004 Griffin et al.
6,749,033 B2 6/2004 Griffin et al.
6,793,681 B1 9/2004 Pope et al.
6,797,236 B2 9/2004 Stoschek
6,797,326 B2 9/2004 Griffin et al.
6,861,098 B2 3/2005 Griffin et al.
6,861,137 B2 3/2005 Griffin et al.
6,878,447 B2 4/2005 Griffin et al.
6,892,836 B1 5/2005 Eyre et al.
7,060,641 B2 6/2006 Qian et al.
7,377,341 B2 5/2008 Middlemiss et al.
7,384,821 B2 6/2008 Sung
7,473,287 B2 1/2009 Belnap et al.
7,516,804 B2 4/2009 Vail
7,552,782 B1 6/2009 Sexton et al.
7,559,695 B2 7/2009 Sexton et al.
7,569,176 B2 8/2009 Pope et al.
7,608,333 B2 10/2009 Eyre et al.
7,635,035 B1 12/2009 Bertagnolli et al.
7,647,993 B2 1/2010 Middlemiss
7,694,757 B2 4/2010 Keshavan et al.
7,740,673 B2 6/2010 Eyre et al.
7,754,333 B2 7/2010 Eyre et al.
7,841,428 B2 11/2010 Bertagnolli
7,845,438 B1 12/2010 Vail et al.
7,866,418 B2 1/2011 Bertagnolli et al.
7,942,219 B2 5/2011 Keshavan et al.
8,034,136 B2 10/2011 Sani
8,066,087 B2 11/2011 Griffo et al.
8,069,937 B2 12/2011 Mukhopadhyay
8,071,173 B1 12/2011 Sani
8,080,074 B2 12/2011 Sani
8,147,572 B2 4/2012 Eyre et al.
8,202,335 B2 6/2012 Cooley et al.
8,297,382 B2 10/2012 Bertagnolli et al.
8,353,371 B2 1/2013 Cooley et al.
8,415,033 B2 4/2013 Matsuzawa et al.
8,616,306 B2 12/2013 Bertagnolli et al.
2003/0019333 A1 1/2003 Scott
2004/0111159 A1 6/2004 Pope et al.
2004/0155096 A1 8/2004 Zimmerman et al.
2005/0044800 A1 3/2005 Hall et al.
2005/0050801 A1 3/2005 Cho et al.
2005/0110187 A1 5/2005 Pope et al.
2005/0117984 A1 6/2005 Eason et al.
2005/0210755 A1 9/2005 Cho et al.
2006/0060392 A1 3/2006 Eyre
2006/0266558 A1 11/2006 Middlemiss et al.
2007/0056778 A1 3/2007 Webb et al.
2007/0079994 A1 4/2007 Middlemiss
2007/0187153 A1 8/2007 Bertagnolli
2007/0187155 A1 8/2007 Middlemiss
2008/0185189 A1 8/2008 Griffo et al.
2008/0206576 A1 8/2008 Qian et al.
2008/0223575 A1 9/2008 Oldham et al.
2008/0223621 A1 9/2008 Middlemiss et al.
2008/0223623 A1 9/2008 Keshavan et al.
2008/0230280 A1* 9/2008 Keshavan et al. ..... 175/434
2008/0247899 A1 10/2008 Cho et al.
2009/0090563 A1 4/2009 Voronin et al.
2009/0120009 A1 5/2009 Sung
2009/0152015 A1 6/2009 Sani et al.
2009/0166094 A1 7/2009 Keshavan et al.
2009/0173015 A1 7/2009 Keshavan et al.
2009/0173547 A1 7/2009 Voronin et al.
2009/0313908 A1 12/2009 Zhang et al.
2010/0012389 A1 1/2010 Zhang et al.
2010/0038148 A1 2/2010 King
2010/0095602 A1 4/2010 Belnap et al.
2010/0122852 A1* 5/2010 Russell et al. ..... 175/428
2010/0155149 A1 6/2010 Keshavan et al.
2010/0181117 A1 7/2010 Scott
2010/0236836 A1 9/2010 Voronin
2010/0243336 A1 9/2010 Dourfaye et al.
2010/0287845 A1 11/2010 Montross et al.
2011/0023375 A1 2/2011 Sani et al.
2011/0031031 A1 2/2011 Vempati et al.
2011/0067929 A1 3/2011 Mukhopadhyay et al.
2011/0083908 A1 4/2011 Shen et al.
2011/0284294 A1 11/2011 Cox et al.
2012/0000136 A1 1/2012 Sani
2012/0037429 A1 2/2012 Davies et al.
2012/0047815 A1 3/2012 Sani
2012/0103701 A1 5/2012 Cho et al.
2012/0138370 A1 6/2012 Mukhopadhyay et al.

(56) References Cited

U.S. PATENT DOCUMENTS

| | | | |
|---|---|---|---|
| 2013/0205677 | A1 | 8/2013 | Bertagnolli et al. |
| 2013/0291443 | A1 | 11/2013 | Naidoo et al. |
| 2014/0283457 | A1 | 9/2014 | Cariveau et al. |

FOREIGN PATENT DOCUMENTS

| | | |
|---|---|---|
| EP | 0 374 424 | 6/1990 |
| EP | 0 699 642 | 3/1996 |
| GB | 2300424 | 11/1996 |
| GB | 2 461 198 | 12/2009 |
| WO | WO 2008/063568 | 5/2008 |
| WO | WO 2010/039346 | 4/2010 |
| WO | 2010/100630 | 9/2010 |
| WO | WO 2010/098978 | 9/2010 |
| WO | WO 2010/100629 | 9/2010 |

OTHER PUBLICATIONS

U.S. Appl. No. 13/323,138, filed Dec. 12, 2011, Miess et al.
Hosomi, Satoru, et al., "Diamond Formation by a Solid State Reaction", Science and Technology of New Diamond, pp. 239-243 (1990).
Liu, Xueran, et al., "Fabrication of the supersaturated solid solution of carbon in copper by mechanical alloying", Materials Characterization, vol. 58, Issue 8 (Jun. 2007), pp. 504-508.
Saji, S., et al., Solid Solubility of Carbon in Copper during Mechanical Alloying, Materials Transactions, vol. 39, No., 7 (1998), pp. 778-781.
Tanaka, T., et al., "Formation of Metastable Phases of Ni—C and Co—C Systems by Mechanical Alloying", Metallurgical Transactions, vol. 23A, Sep. 1992, pp. 2431-2435.
Yamane, T., et al., "Solid solubility of carbon in copper mechanically alloyed", Journal of Materials Science Letters 20 (2001), pp. 259-260.
U.S. Appl. No. 12/394,356, Nov. 30, 2011, Issue Notification.
U.S. Appl. No. 13/171,735, Jan. 24, 2013, Final Office Action.
Ledbetter, H.M., et al. "Elastic Properties of Metals and Alloys. II. Copper", Journal of Physics and Chemical Reference Data, vol. 3, No. 4, 1974. pp. 897-935.
U.S. Appl. No. 13/690,397, Feb. 14, 2013, Office Action.
U.S. Appl. No. 11/545,929, filed Oct. 10, 2006, Bertagnolli.
U.S. Appl. No. 61/068,120, filed Mar. 3, 2008, Vail.
U.S. Appl. No. 12/394,356, filed Feb. 27, 2009, Vail.
U.S. Appl. No. 12/397,969, filed Apr. 9, 2009, Bertagnolli.
U.S. Appl. No. 12/548,584, filed Aug. 27, 2009, Bertagnolli.
Akaishi, Minoru, "Synthesis of polycrystalline diamond compact with magnesium carbonate and its physical properties," Diamond and Related Materials, 1996 (pp. 2-7).
Glowka, D.A. & Stone, C.M., "Effects of Termal and Mechanical Loading on PDC Bit Life", SPE Drilling Engineering, Jun. 1986 (pp. 201-214).
Hsueh, C.H. & Evans, A.G., "Residual Stresses in Metal/Ceramic Bonded Strips", J. Am. Ceram. Soc., 68 [5] (1985) pp. 241-248.
Lin, Tze-Pin; Hood, Michael & Cooper George A., "Residual Stresses in Polycrystalline Diamond Compacts", J. Am. Ceram Soc., 77 [6] (1994) pp. 1562-1568.
Orwa, J.O., et al., "Diamond nanocrystals formed by direct implantation of fused silica with carbon," Journal of Applied Physics, vol. 90, No. 6, 2001, pp. 3007-3018.
Radtke, Robert, "Faster Drilling, Longer Life: Thermally Stable Diamond Drill Bit Cutters," Drilling Systems, Summer 2004 (pp. 5-9).
Suryanarayana, C., "Novel Methods of Brazing Dissimilar Materials," Advanced Materials & Processes, Mar. 2001 (3 pgs).
Timoshenko, S.P. & Goodler, J.N., "Theory of Elasticity", McGraw-Hill Classic Textbook Reissue 1934, pp. 8-11, 456-458.
Tomlinson, P.N. et al. "Syndax3 Pins-New Concepts in PCD Drilling," Rock Drilling, IDR 3/92, 1992 (pp. 109-114).
Ueda, Fumihiro, "Cutting performance of sintered diamond with MgCO3 as a sintering agent," Materials Science and Engineering, 1996 (pp. 260-263).
U.S. Appl. No. 11/545,929, Jan. 21, 2009, Office Action.
U.S. Appl. No. 11/545,929, Aug. 27, 2009, Office Action.
U.S. Appl. No. 11/545,929, Apr. 15, 2010, Office Action.
U.S. Appl. No. 11/545,929, Jul. 21, 2010, Advisory Action.
U.S. Appl. No. 60/850,969, filed Oct. 10, 2006, Cooley, et al.
U.S. Appl. No. 60/860,098, filed Nov. 20, 2006, Sani.
U.S. Appl. No. 60/876,701, filed Dec. 21, 2006, Sani.
U.S. Appl. No. 13/285,198, filed Oct. 31, 2011, Sani.
Declaration of Prior Sales of Terracut PDCS executed by Kenneth E. Bertagnolli Feb. 3, 2011.
Declaration of Prior Sales of Terracut PDCS executed by Paul D. Jones Feb. 3, 2011.
Ekimov, E.A., et al. "Mechanical Properties and Microstructure of Diamond-SiC Nanocomposites" Inorganic Materials, vol. 38, No. 11, 2002, pp. 1117-1122.
International Search Report and Written Opinion for PCT International Application No. PCT/US2007/024090; Apr. 15, 2008.
International Search Report and Written Opinion from International Application No. PCT/US2011/060380 dated Mar. 12, 2012.
U.S. Appl. No. 11/983,619, May 26, 2010, Restriction Requirement.
U.S. Appl. No. 11/983,619, Aug. 9, 2010, Office Action.
U.S. Appl. No. 11/983,619, Mar. 28, 2011, Office Action.
U.S. Appl. No. 11/983,619, Jun. 16, 2011, Notice of Allowance.
U.S. Appl. No. 11/983,619, Sep. 21, 2011, Issue Notification.
U.S. Appl. No. 12/271,081, Dec. 22, 2010, Restriction Requirement.
U.S. Appl. No. 12/271,081, Mar. 31, 2011, Office Action.
U.S. Appl. No. 12/271,081, Aug. 8, 2011, Office Action.
U.S. Appl. No. 12/271,081, Oct. 5, 2011, Notice of Allowance.
U.S. Appl. No. 12/363,104, Oct. 14, 2010, Office Action.
U.S. Appl. No. 12/363,104, Apr. 12, 2011, Office Action.
U.S. Appl. No. 12/363,104, Aug. 25, 2011, Notice of Allowance.
U.S. Appl. No. 13/032,350, Nov. 26, 2012, Restriction Requirement.
U.S. Appl. No. 13/032,350, Mar. 14, 2013, Office Action.
U.S. Appl. No. 13/230,125, May 23, 2012, Restriction Requirement.
U.S. Appl. No. 13/230,125, Jul. 11, 2012, Office Action.
U.S. Appl. No. 13/230,125, Jan. 18, 2013, Office Action.
U.S. Appl. No. 13/285,198, Apr. 3, 2012, Restriction Requirement.
U.S. Appl. No. 13/285,198, Jul. 11, 2012, Office Action.
U.S. Appl. No. 13/285,198, Feb. 5, 2013, Notice of Allowance.
U.S. Appl. No. 13/292,491, Aug. 8, 2012, Restriction Requirement.
U.S. Appl. No. 13/292,491, Feb. 11, 2013, Office Action.
U.S. Appl. No. 13/100,388, filed May 4, 2011, Jones et al.
U.S. Appl. No. 13/230,125, May 1, 2013, Notice of Allowance.
U.S. Appl. No. 13/292,900, May 23, 2013, Office Action.
U.S. Appl. No. 13/690,397, May 29, 2013, Notice of Allowance.
U.S. Appl. No. 12/961,787, May 29, 2013, Restriction Requirement.
U.S. Appl. No. 13/171,735, filed Jun. 29, 2011, Bertagnolli.
U.S. Appl. No. 12/394,356, Sep. 1, 2011, Notice of Allowance.
U.S. Appl. No. 13/690,397, filed Nov. 30, 2012, Miess et al.
U.S. Appl. No. 12/548,584, Jan. 3, 2013, Office Action.
U.S. Appl. No. 13/397,971, filed Feb. 16, 2012, Miess et al.
U.S. Appl. No. 11/545,929, Mar. 20, 2012, Notice of Allowance.
U.S. Appl. No. 11/545,929, Jul. 18, 2012, Issue Notification.
U.S. Appl. No. 12/397,969, May 25, 2012, Notice of Allowance.
U.S. Appl. No. 12/397,969, Nov. 14, 2012, Issue Notification.
U.S. Appl. No. 12/548,584, May 18, 2012, Office Action.
U.S. Appl. No. 12/548,584, Oct. 24, 2012, Office Action.
U.S. Appl. No. 13/171,735, Aug. 17, 2012, Office Action.
U.S. Appl. No. 13/953,453, filed Jul. 29, 2013, Sani.
U.S. Appl. No. 12/548,584, Jun. 14, 2013, Office Action.
U.S. Appl. No. 12/548,584, Sep. 26, 2013, Office Action.
U.S. Appl. No. 13/032,350, Sep. 30, 2013, Office Action.
U.S. Appl. No. 13/171,735, Jul. 12, 2013, Office Action.
U.S. Appl. No. 13/230,125, Aug. 21, 2013, Issue Notification.
U.S. Appl. No. 13/285,198, Jul. 22, 2013, Notice of Allowance.
U.S. Appl. No. 13/292,491, Jul. 18, 2013, Office Action.
U.S. Appl. No. 13/690,397, Aug. 9, 2013, Office Action.
U.S. Appl. No. 13/917,952, Jul. 31, 2013, Office Action.
U.S. Appl. No. 12/961,787, Aug. 30, 2013, Office Action.
U.S. Appl. No. 13/323,138, Oct. 1, 2013, Office Action.
U.S. Appl. No. 13/953,453, Sep. 19, 2013, Office Action.
U.S. Appl. No. 13/953,453, Oct. 10, 2013, Office Action.
U.S. Appl. No. 14/067,831, filed Oct. 30, 2013, Bertagnolli et al.

(56) References Cited

OTHER PUBLICATIONS

U.S. Appl. No. 14/178,118, filed Feb. 11, 2014, Mukhopadhyay et al.
U.S. Appl. No. 13/100,388, Oct. 18, 2013, Office Action.
U.S. Appl. No. 13/100,388, Jan. 15, 2014, Office Action.
U.S. Appl. No. 13/171,735, Jan. 10, 2014, Office Action.
U.S. Appl. No. 13/285,198, Nov. 22, 2013, Notice of Allowance.
U.S. Appl. No. 13/292,491, Oct. 29, 2013, Office Action.
U.S. Appl. No. 13/690,397, Nov. 25, 2013, Office Action.
U.S. Appl. No. 13/917,952, Nov. 13, 2013, Office Action.
U.S. Appl. No. 13/292,900, Oct. 22, 2013, Notice of Allowance.
U.S. Appl. No. 13/292,900, Nov. 25, 2013, Notice of Allowance.
U.S. Appl. No. 13/292,900, Jan. 30, 2014, Notice of Allowance.
U.S. Appl. No. 13/323,138, Nov. 29, 2013, Notice of Allowance.
U.S. Appl. No. 12/548,584, Mar. 6, 2014, Notice of Allowance.
U.S. Appl. No. 13/032,350, Apr. 15, 2014, Notice of Allowance.
U.S. Appl. No. 13/171,735, May 7, 2014, Notice of Allowance.
U.S. Appl. No. 13/285,198, Apr. 11, 2014, Notice of Allowance.
U.S. Appl. No. 13/292,491, Mar. 21, 2014, Office Action.
U.S. Appl. No. 13/690,397, Mar. 12, 2014, Notice of Allowance.
U.S. Appl. No. 13/917,952, Feb. 26, 2014, Notice of Allowance.
U.S. Appl. No. 12/961,787, Apr. 11, 2014, Office Action.
U.S. Appl. No. 13/323,138, Mar. 12, 2014, Notice of Allowance.
U.S. Appl. No. 13/953,453, Mar. 18, 2014, Office Action.
U.S. Appl. No. 13/292,900, filed May 28, 2014, Issue Notification.
U.S. Appl. No. 14/264,932, filed Apr. 29, 2014, Vail.
U.S. Appl. No. 14/297,359, filed Jun. 5, 2014, Miess et al.
U.S. Appl. No. 14/327,264, filed Jul. 9, 2014, Sani.
U.S. Appl. No. 14/330,851, filed Jul. 14, 2014, Sani.
Decker, et al., "High-Pressure Calibration: A Critical Review," J. Phys. Chem. Ref. Data, 1, 3 (1972).
Rousse, et al. "Structure of the Intermediate Phase of PbTe at High Pressure," Physical Review B: Condensed Matter and Materials Physics, 71, 224116 (2005).
U.S. Appl. No. 12/548,584, filed Jun. 25, 2014, Issue Notification.
U.S. Appl. No. 13/032,350, filed Aug. 13, 2014, Issue Notification.
U.S. Appl. No. 13/100,388, filed Jun. 17, 2014, Notice of Allowance.
U.S. Appl. No. 13/100,388, filed Aug. 4, 2014, Notice of Allowance.
U.S. Appl. No. 13/285,198, filed Jul. 30, 2014, Issue Notification.
U.S. Appl. No. 13/292,491, filed Aug. 8, 2014, Office Action.
U.S. Appl. No. 13/690,397, filed Jul. 9, 2014, Issue Notification.
U.S. Appl. No. 13/917,952, filed Jun. 11, 2014, Issue Notification.
U.S. Appl. No. 13/323,138, filed Jul. 29, 2014, Notice of Allowance.
U.S. Appl. No. 13/397,971, filed Jun. 19, 2014, Office Action.
U.S. Appl. No. 13/953,453, filed Jun. 24, 2014, Notice of Allowance.
ASTM B887-03 (2008) "Standard Test Method for Determination of Coercivity (Hcs) of Cemented Carbides".
ASTM B886-03 (2008), "Standard Test Method for Determination of Magnetic Saturation (Ms) of Cemented Carbides".
U.S. Appl. No. 14/495,759, filed Sep. 24, 2014, Sani.
U.S. Appl. No. 14/504,253, filed Oct. 1, 2014, Bertagnolli et al.
U.S. Appl. No. 14/512,007, filed Oct. 10, 2014, Bertagnolli et al.
U.S. Appl. No. 13/100,388, filed Nov. 7, 2014, Notice of Allowance.
U.S. Appl. No. 13/171,735, filed Aug. 6, 2014, Issue Notification.
U.S. Appl. No. 13/323,138, filed Nov. 25, 2014, Issue Notification.
U.S. Appl. No. 13/397,971, filed Nov. 26, 2014, Notice of Allowance.
U.S. Appl. No. 13/100,388, filed Mar. 4, 2015, Notice of Allowance.
U.S. Appl. No. 13/953,453, filed Feb. 12, 2015, Notice of Allowance.
U.S. Appl. No. 13/953,453, filed Feb. 25, 2015, Issue Notification.

* cited by examiner

POLYCRYSTALLINE DIAMOND COMPACT INCLUDING A POLYCRYSTALLINE DIAMOND TABLE WITH A THERMALLY-STABLE REGION HAVING AT LEAST ONE LOW-CARBON-SOLUBILITY MATERIAL AND APPLICATIONS THEREFOR

CROSS-REFERENCE TO RELATED APPLICATIONS

This application is a continuation-in-part of U.S. patent application Ser. No. 11/545,929 filed on 10 Oct. 2006, now U.S. Pat. No. 8,236,074. This application is also a continuation-in-part of U.S. patent application Ser. No. 12/394,356 filed on 27 Feb. 2009, now U.S. Pat. No. 8,080,071, which claims the benefit of U.S. Provisional Application No. 61/068,120 filed on 3 Mar. 2008. The contents of each of the foregoing applications are incorporated herein, in their entirety, by this reference.

BACKGROUND

Wear-resistant, polycrystalline diamond compacts ("PDCs") are utilized in a variety of mechanical applications. For example, PDCs are used in drilling tools (e.g., cutting elements, gage trimmers, etc.), machining equipment, bearing apparatuses, wire-drawing machinery, and in other mechanical apparatuses.

PDCs have found particular utility as superabrasive cutting elements in rotary drill bits, such as roller-cone drill bits and fixed-cutter drill bits. A PDC cutting element typically includes a superabrasive diamond layer commonly known as a diamond table. The diamond table is formed and bonded to a substrate using a high-pressure/high-temperature ("HPHT") process. The PDC cutting element may also be brazed directly into a preformed pocket, socket, or other receptacle formed in a bit body. The substrate may often be brazed or otherwise joined to an attachment member, such as a cylindrical backing. A rotary drill bit typically includes a number of PDC cutting elements affixed to the bit body. It is also known that a stud carrying the PDC may be used as a PDC cutting element when mounted to a bit body of a rotary drill bit by press-fitting, brazing, or otherwise securing the stud into a receptacle formed in the bit body.

Conventional PDCs are normally fabricated by placing a cemented carbide substrate into a container with a volume of diamond particles positioned on a surface of the cemented carbide substrate. A number of such containers may be loaded into an HPHT press. The substrate(s) and volume of diamond particles are then processed under HPHT conditions in the presence of a catalyst material that causes the diamond particles to bond to one another to form a matrix of bonded diamond grains defining a polycrystalline diamond ("PCD") table. The catalyst material is often a metallic catalyst (e.g., cobalt, nickel, iron, or alloys thereof) that is used for promoting intergrowth of the diamond particles.

In one conventional approach, a constituent of the cemented carbide substrate, such as cobalt from a cobalt-cemented tungsten carbide substrate, liquefies and sweeps from a region adjacent to the volume of diamond particles into interstitial regions between the diamond particles during the HPHT process. The cobalt acts as a metal-solvent catalyst to promote intergrowth between the diamond particles, which results in the formation of a matrix of bonded diamond grains having diamond-to-diamond bonding therebetween, with interstitial regions between the bonded diamond grains being occupied by the metal-solvent catalyst.

The presence of the metal-solvent catalyst in the PCD table is believed to reduce the thermal stability of the PCD table at elevated temperatures. For example, some of the diamond grains can undergo a chemical breakdown or back-conversion to a non-diamond form of carbon via interaction with the metal-solvent catalyst. At elevated high temperatures, portions of diamond grains may transform to carbon monoxide, carbon dioxide, graphite, or combinations thereof, causing degradation of the mechanical properties of the PCD table.

Despite the availability of a number of different PDCs, manufacturers and users of PDCs continue to seek PDCs that exhibit improved toughness, wear resistance, thermal stability, or combinations of the foregoing.

SUMMARY

Embodiments of the invention relate to PDCs comprising a PCD table including a thermally-stable region having at least one low-carbon-solubility material disposed interstitially between bonded diamond grains thereof, and methods of fabricating such PDCs. The at least one low-carbon-solubility material may exhibit a melting temperature of about 1300° C. or less and a bulk modulus at 20° C. of less than about 150 GPa. The at least one low-carbon-solubility material, in combination with the high diamond-to-diamond bond density of the diamond grains, may enable the at least one low-carbon-solubility material to be extruded between the diamond grains and out of the PCD table before causing the PCD table to fail during cutting operations as a result of interstitial-stress-related fracture.

In an embodiment, a PDC includes a substrate, and a PCD table bonded to the substrate. The PCD table includes a plurality of diamond grains exhibiting diamond-to-diamond bonding therebetween and defining a plurality of interstitial regions. The PCD table further includes at least one low-carbon-solubility material disposed in at least a portion of the plurality of interstitial regions. The at least one low-carbon-solubility material exhibits a melting temperature of about 1300° C. or less and a bulk modulus at 20° C. of less than about 150 GPa.

In an embodiment, a method of manufacturing a PDC includes forming an assembly including an at least partially leached polycrystalline diamond table including a plurality of interstitial regions therein positioned at least proximate to a substrate and at least proximate to at least one layer including at least one low-carbon-solubility material. The at least one low-carbon-solubility material exhibits a melting temperature of about 1300° C. or less and a bulk modulus at 20° C. of less than about 150 GPa. The method further includes infiltrating the at least one low-carbon-solubility material into at least a portion of the interstitial regions of a selected region of the at least partially leached polycrystalline diamond table.

In an embodiment, a method of manufacturing a PDC in a single-step HPHT process is disclosed. The method includes forming an assembly including a plurality of diamond particles disposed at least proximate to a substrate and at least proximate to at least one low-carbon-solubility material having carbon ions implanted therein. The at least one low-carbon-solubility material exhibits a melting temperature of about 1300° C. or less and a bulk modulus at 20° C. of less than about 150 GPa. The method further includes subjecting the assembly to a high-pressure/high-temperature process to sinter the diamond particles in the presence of the at least one low-carbon-solubility material having the carbon ions implanted therein to form a polycrystalline diamond table that bonds to the substrate.

Other embodiments include applications utilizing the disclosed PDCs in various articles and apparatuses, such as rotary drill bits, bearing apparatuses, wire-drawing dies, machining equipment, and other articles and apparatuses.

Features from any of the disclosed embodiments may be used in combination with one another, without limitation. In addition, other features and advantages of the present disclosure will become apparent to those of ordinary skill in the art through consideration of the following detailed description and the accompanying drawings.

BRIEF DESCRIPTION OF THE DRAWINGS

The drawings illustrate several embodiments of the invention, wherein identical reference numerals refer to identical elements or features in different views or embodiments shown in the drawings.

DETAILED DESCRIPTION

Embodiments of the invention relate to PDCs comprising a PCD table including a thermally-stable region having at least one low-carbon-solubility material disposed interstitially between bonded diamond grains thereof, and methods of fabricating such PDCs. The at least one low-carbon-solubility material exhibits a melting temperature of about 1300° C. or less and a bulk modulus at 20° C. of less than about 150 GPa. The at least one low-carbon-solubility material, in combination with the high diamond-to-diamond bond density of the diamond grains, may enable the at least one low-carbon-solubility material to be extruded between the diamond grains before causing the PCD table to fracture during cutting operations as a result of interstitial stresses. As such, the PCD table of the PDCs exhibits a high degree of damage tolerance, wear resistance, and thermal stability. The PDCs disclosed herein may be used in a variety of applications, such as rotary drill bits, bearing apparatuses, wire-drawing dies, machining equipment, and other articles and apparatuses.

Figure 1:
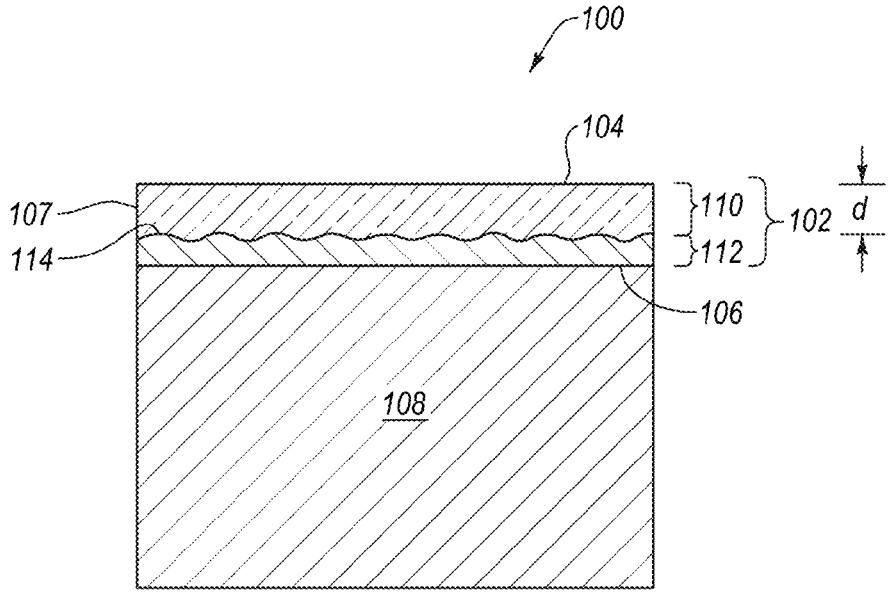
FIG. 1 is a cross-sectional view of an embodiment of a PDC including a PCD table having at least one low-carbon-solubility material disposed therein.

FIG. 1 is a cross-sectional view of an embodiment of a PDC 100 including a PCD table 102 having at least one low-carbon-solubility material disposed therein. The PCD table 102 includes a working upper surface 104, a generally opposing interfacial surface 106, and at least one lateral surface 107 extending therebetween. It is noted that at least a portion of the at least one lateral surface 107 may also function as a working surface that contacts a subterranean formation during drilling. Additionally, the PCD table 102 may include a chamfer that extends about the upper surface 104 thereof or other edge geometry.

The interfacial surface 106 of the PCD table 102 is bonded to a substrate 108. The substrate 108 may include, without limitation, cemented carbides, such as tungsten carbide, titanium carbide, chromium carbide, niobium carbide, tantalum carbide, vanadium carbide, or combinations thereof cemented with a metallic cementing constituent, such as iron, nickel, cobalt, or alloys thereof. In an embodiment, the substrate 108 comprises cobalt-cemented tungsten carbide.

Although the interfacial surface 106 of the PCD table 102 is depicted in FIG. 1 as being substantially planar, in other embodiments, the interfacial surface 106 may exhibit a selected nonplanar topography and the substrate 108 may exhibit a correspondingly configured interfacial surface.

The PCD table 102 includes a plurality of directly bonded-together diamond grains having diamond-to-diamond bonding (e.g., $sp^3$ bonding) therebetween. In an embodiment, the PCD table 102 may be integrally formed on the substrate 108 (i.e., diamond particles are sintered on or near the substrate 108 to form the PCD table 102). In another embodiment, the PCD table 102 is a pre-sintered PCD table 102 that is infiltrated and attached to the substrate 108. The plurality of bonded diamond grains define a plurality of interstitial regions. The PCD table 102 includes a thermally-stable first region 110 that may be remote from the substrate 108 and extends inwardly from the upper surface 104 to a depth "d" within the PCD table 102. As used herein, the phrase "thermally-stable region" refers to a region of a PCD table that exhibits a relatively increased thermal stability compared to one or more other regions of the same PCD table. The first region 110 includes a first portion of the interstitial regions. A second region 112 of the PCD table 102 adjacent to the substrate 108 includes a second portion of the interstitial regions.

At least a portion of the interstitial regions of the first region 110 includes the at least one low-carbon-solubility material disposed therein. For example, the at least one low-carbon-solubility material is present in the first region 110 in an amount of about 1 weight % to about 10 weight %, about 2 weight % to about 10 weight %, about 3.5 weight % to about 8 weight %, about 1 weight % to about 3 weight %, about 2.5 weight % to about 6 weight %, or about 5 weight % to about 9 weight %, with the balance substantially being diamond grains and residual metal-solvent catalyst used in the sintering of the diamond grains (if present). Several examples of low-carbon-solubility materials will be discussed in more detail below. However, a low-carbon-solubility material is a material, such as copper, tin, aluminum, combinations thereof, or alloys thereof that does not have a high solubility for carbon, generally does not effectively catalyze growth of PCD, and is not a good carbide former. For example, a low-carbon-solubility material has a maximum solubility of carbon of less than about 0.1 weight % in its solid phase at atmospheric-pressure. In a low-carbon-solubility material/carbon chemical system having a eutectic point, a low-carbon-solubility material has a maximum solubility of carbon of less than about 0.1 weight % in its solid phase at the atmospheric-pressure eutectic temperature of the low-carbon-solubility material/carbon chemical system. Cobalt, iron, nickel, silicon, and alloys comprising a majority of at least one of cobalt, iron, nickel, or silicon are examples of materials that are not low-carbon-solubility materials. While the at least one low-carbon-solubility materials disclosed herein may include small amounts of diamond catalytic metals (e.g., manganese, chromium, iron, nickel, cobalt, ruthenium, rhodium, palladium, osmium, iridium, platinum, tantalum, combinations thereof, and alloys thereof) and/or carbide forming elements (e.g., scandium, titanium, vanadium, yttrium, zirconium, niobium, molybdenum, technetium, lanthanum, cerium, praseodymium, tungsten, rhenium, thorium, uranium, plutonium, silicon, combinations thereof, and alloys thereof), the concentration of such elements is low enough so that the at least one low-carbon-solubility material does not have a high solubility for carbon, still generally does not effectively catalyze growth of PCD, and does not significantly consume diamond during manufacture of the PCD table 102 by carbide formation. However, in some embodiments, the at least one low-carbon-solubility material is substantially free of diamond catalytic metals (e.g., manganese, chromium, iron, nickel, cobalt, ruthenium, rhodium, palladium, osmium, iridium, platinum, tantalum, combinations thereof, and alloys thereof) and/or carbide forming elements (e.g., scandium, titanium, vanadium, yttrium, zirconium, niobium, molybdenum, technetium, lanthanum, cerium, praseodymium, tungsten, rhenium, thorium, uranium, plutonium, silicon, combinations thereof, and alloys thereof).

As the at least one low-carbon-solubility material may not effectively catalyze PCD growth, the first region 110 is thermally-stable and exhibits improved wear resistance and/or thermal stability compared to if the first region 110 included a solvent catalyst (e.g., cobalt) therein. When the PCD table 102 is a pre-sintered PCD table, a residual amount of metallic catalyst may also be present in the interstitial regions of the first region 110 and the second region 112 that was used to initially catalyze formation of diamond-to-diamond bonding between the diamond grains of the PCD table 102. The residual metallic catalyst may comprise iron, nickel, cobalt, or alloys thereof. For example, the residual metallic catalyst may be present in the PCD table 102 in amount of about 2 weight % or less, about 0.8 weight % to about 1.50 weight %, or about 0.86 weight % to about 1.47 weight %.

At least a portion of the interstitial regions of the second region 112 includes a metallic constituent (e.g., the metallic cementing constituent) disposed therein that may be provided and infiltrated from the substrate 108. However, in other embodiments, the metallic constituent may be provided from another source, such as a thin disc of the metallic constituent or another source. For example, the metallic constituent may comprise iron, nickel, cobalt, or alloys thereof.

A nonplanar boundary 114 may be formed between the first region 110 and the second region 112 of the PCD table 102. The nonplanar boundary 114 exhibits a geometry characteristic of the metallic constituent being only partially infiltrated into the second region 112 of the PCD table 102. If the metallic constituent had infiltrated the entire PCD table 102 so that the interstitial regions of the first region 110 were also occupied by the metallic constituent and subsequently removed in a leaching process to the depth "d," a boundary between the first region 110 and the second region 112 would be substantially planar and indicative of being defined by a leaching process.

In an embodiment, the depth "d" to which the first region 110 extends may be almost the entire thickness of the PCD table 102. In another embodiment, the depth "d" may be an intermediate depth within the PCD table 102 of about 50 μm to about 500 μm, about 200 μm to about 400 μm, about 300 μm to about 450 μm, about 0.2 mm to about 1.5 mm, about 0.5 mm to about 1.0 mm, about 0.65 mm to about 0.9 mm, or about 0.75 mm to about 0.85 mm. As the depth "d" of the first region 110 increases, the wear resistance and/or thermal stability of the PCD table 102 may increase.

The at least one low-carbon-solubility material of the first region 110 of the PCD table 102 may be selected from a number of different materials exhibiting a melting temperature of about 1300° C. or less and a bulk modulus at 20° C. of about 150 GPa or less. As used herein, melting temperature refers to the lowest temperature at which melting of a material begins at standard pressure conditions (i.e., 100 kPa). For example, depending upon the composition of the at least one low-carbon-solubility material, the at least one low-carbon-solubility material may melt over a temperature range such as occurs when the at least one low-carbon-solubility material is an alloy with a hypereutectic composition or a hypoeutectic composition where melting begins at the solidus temperature and is substantially complete at the liquidus temperature. In other cases, the at least one low-carbon-solubility material may have a single melting temperature as occurs in a substantially pure metal or a eutectic alloy.

The at least one low-carbon-solubility material of the first region 110 may be chosen from a number of different metals, alloys, and semiconductors, such as copper, tin, indium, gadolinium, germanium, gold, silver, aluminum, lead, zinc, cadmium, bismuth, antimony, combinations thereof, and alloys thereof. In an embodiment, the at least one low-carbon-solubility material may be an alloy of copper and gold and/or silver to improve the corrosion resistance of the at least one low-carbon-solubility material. Thus, the at least one low-carbon-solubility material may be a metallic, non-ceramic material. In one or more embodiments, the at least one low-carbon-solubility material exhibits a coefficient of thermal expansion of about $3\times10^{-6}$ per ° C. to about $20\times10^{-6}$ per ° C., a melting temperature of about 180° C. to about 1300° C., and a bulk modulus at 20° C. of about 30 GPa to about 150 GPa; a coefficient of thermal expansion of about $15\times10^{-6}$ per ° C. to about $20\times10^{-6}$ per ° C., a melting temperature of about 180° C. to about 1100° C., and a bulk modulus at 20° C. of about 50 GPa to about 130 GPa; a coefficient of thermal expansion of about $15\times10^{-6}$ per ° C. to about $20\times10^{-6}$ per ° C., a melting temperature of about 950° C. to about 1100° C. (e.g., 1090° C.), and a bulk modulus at 20° C. of about 120 GPa to about 140 GPa (e.g., about 130 GPa); or a coefficient of thermal expansion of about $15\times10^{-6}$ per ° C. to about $20\times10^{-6}$ per ° C., a melting temperature of about 180° C. to about 300° C. (e.g., about 250° C.), and a bulk modulus at 20° C. of about 45 GPa to about 55 GPa (e.g., about 50 GPa). For example, the at least one low-carbon-solubility material may exhibit a melting temperature of less than about 1200° C. (e.g., less than about 1100° C.) and a bulk modulus at 20° C. of less than about 140 GPa (e.g., less than about 130 GPa). For example, the at least one low-carbon-solubility material may exhibit a melting temperature of less than about 1200° C. (e.g., less than 1100° C.), and a bulk modulus at 20° C. of less than about 130 GPa.

With respect to some specific materials for the at least one low-carbon-solubility material, for example, tin exhibits a coefficient of thermal expansion of about $20.0\times10^{-6}$ per ° C., a melting temperature of about 232° C., and a bulk modulus at 20° C. of about 52 GPa. For example, copper exhibits a coefficient of thermal expansion of about $16.6\times10^{-6}$ per ° C., a melting temperature of about 1083° C., and a bulk modulus at 20° C. of about 130 GPa. For example, aluminum exhibits a coefficient of thermal expansion of about $2.5\times10^{-6}$ per ° C., a melting temperature of about 658° C., and a bulk modulus at 20° C. of about 75 GPa. Of course, alloys of these metals may also exhibit thermal expansion, melting temperature, and bulk modulus values within the ranges disclosed above.

The strength of the diamond-to-diamond bonding between the diamond grains of the PCD table 102 is sufficiently strong and the density is sufficiently high so that the at least one low-carbon-solubility material extrudes out of exposed interstitial regions of the upper surface 104 and/or the at least one lateral surface 107 of the PCD table 102 during heating thereof at a temperature of at least about 0.6 times (e.g., about 0.6 to about 0.8 times) the absolute melting temperature of the at least one low-carbon-solubility material at standard pressure (100 kPa) without fracturing the PCD table 102. This is due to the relatively low bulk modulus and melting temperature of the at least one low-carbon-solubility material in combination with the high strength and high density of the diamond-to-diamond bonds. In other words, the at least one low-carbon-solubility material is not capable of exerting sufficient thermal stresses on the surrounding diamond grains to cause fracturing of the PCD table 102 and, thus, is extruded out of the PCD table 102 instead of fracturing the PCD table 102 during cutting operations.

In some embodiments, a selected portion of the at least one low-carbon-solubility material may be at least partially removed from a selected region of the PCD table 102 in a leaching process. However, it should be noted that the inventors currently believe that not removing any of the at least one low-carbon-solubility material from the PCD table 102 may improve the impact resistance of the PCD table 102 because the ductile at least one low-carbon-solubility material may help arrest crack propagation compared to if the at least one low-carbon-solubility material were absent. A suitable acid (e.g., nitric acid, hydrochloric acid, hydrofluoric acid, or mixtures thereof) or base may be used to leach the selected portion of the at least one low-carbon-solubility material from the selected region of the PCD table 102. Even after leaching, a residual amount of the at least one low-carbon-solubility material may be present in the PCD table 102 in an amount of about 0.8 weight % to about 1.50 weight %. As an example, the leached selected region may extend inwardly from the upper surface 104 and/or the at least one lateral surface 107 to a depth of about 50 μm to about 700 μm, about 250 μm to about 400 μm, about 250 μm to about 350 μm, about 250 μm to about 300 μm, about 250 μm to about 275 μm, or about 500 μm to about 1000 μm.

Figure 2:
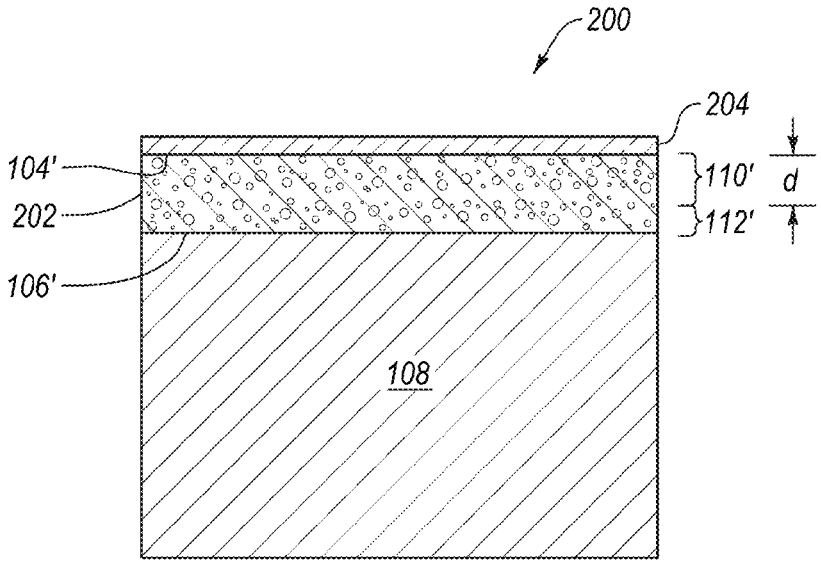
FIG. 2 is a cross-sectional view of an assembly to be processed under HPHT conditions to form the PDC shown in FIG. 1 according to an embodiment of method.

FIG. 2 is a cross-sectional view of an assembly 200 to be processed under HPHT conditions to form the PDC 100 shown in FIG. 1 according to an embodiment of a method. The assembly 200 includes an at least partially leached PCD table 202 disposed between the substrate 108 and at least one layer 204 including one or more of the aforementioned low-carbon-solubility materials. The at least partially leached PCD table 202 includes an upper surface 104' and a back surface 106'. The at least partially leached PCD table 202 also includes a plurality of interstitial regions that were previously completely occupied by a metallic catalyst and forms a network of at least partially interconnected pores that extend between the upper surface 104' and the back surface 106'.

The at least partially leached PCD table 202 and the at least one layer 204 may be placed in a pressure transmitting medium (e.g., a refractory metal can embedded in pyrophyllite or other pressure transmitting medium) to form a cell assembly. The cell assembly, including the at least partially leached PCD table 202 and the at least one layer 204, may be subjected to an HPHT process using an ultra-high pressure press to create temperature and pressure conditions at which diamond is stable. The temperature of the HPHT process may be at least about 1000° C. (e.g., about 1200° C. to about 1600° C., or about 1200° C. to about 1300° C.) and the pressure of the HPHT process may be at least 4.0 GPa (e.g., about 5.0 GPa to about 10.0 GPa, or about 5.0 GPa to about 8.0 GPa) for a time sufficient to at least partially melt and infiltrate the at least partially leached PCD table 202 with the at least one low-carbon-solubility material from the at least one layer 204 and the metallic cementing constituent from the substrate 108. The at least one low-carbon-solubility material is capable of infiltrating and/or wetting the diamond grains to fill the interstitial regions between the bonded diamond grains of the at least partially leached PCD table 202.

During the HPHT process, the at least one low-carbon-solubility material from the at least one layer 204 at least partially melts and infiltrates into a first region 110' of the at least partially leached PCD table 202 prior to or substantially simultaneously with the metallic cementing constituent from the substrate 108 at least partially melting and infiltrating into a second region 112' of the at least partially leached PCD table 202 that is located adjacent to the substrate 108. The at least one low-carbon-solubility material from the at least one layer 204 infiltrates into the first region 110' of the at least partially leached PCD table 202 generally to the depth "d" to fill at least a portion of the interstitial regions thereof. As the at least one low-carbon-solubility material is not a strong carbide former (e.g., silicon), the at least one low-carbon-solubility material does not consume portions of the diamond grains via a chemical reaction so that the strength of the diamond grain structure may be preserved. It should also be noted that the composition of the at least one low-carbon-solubility material may change after infiltration. For example, if the at least one low-carbon-solubility material includes a mixture of copper and tin particles or discs, the copper and tin may form a copper-tin alloy after HPHT processing and infiltration. As another example, in some embodiments, when the at least one low-carbon-solubility material is aluminum, the aluminum may partially or substantially completely react with oxygen to form aluminum oxide ("$Al_2O_3$") depending upon the atmosphere in which the HPHT processing is conducted. The amount of the at least one low-carbon-solubility material in the at least one layer 204 may be selected so that it only infiltrates into the first region 110' of the at least partially leached PCD table 202 to the depth "d."

The HPHT conditions are also sufficient to at least partially melt the metallic cementing constituent present in the substrate 108 (e.g., cobalt in a cobalt-cemented tungsten carbide substrate), which infiltrates into at least a portion of the interstitial regions of the second region 112' of the at least partially leached PCD table 202. However, the depth of infiltration of the metallic cementing constituent from the substrate 108 may be limited by the presence of the at least one low-carbon-solubility material in the first region 110'. Upon cooling from the HPHT process, the metallic cementing constituent infiltrated into the at least partially leached PCD table 202 forms a strong metallurgical bond between the second region 112' and the substrate 108.

Referring to FIG. 1 along with FIG. 2, in some embodiments, the depth "d" extends the entire thickness of the PCD table 102 or almost the entire thickness of the PCD table 102. However, the metallic cementing constituent may form a strong metallurgical bond between the substrate 108 and a portion of the diamond grains of the second region 112 even when the metallic cementing constituent is located just along or near the interface between the PCD table 102 and the substrate 108.

It should be noted that the thickness of the at least partially leached PCD table 202 may be reduced after HPHT processing. Before and/or after HPHT processing, the infiltrated PCD table represented as the PCD table 102 shown in FIG. 1 may be subjected to one or more types of finishing operations, such as grinding, machining, or combinations of the foregoing.

The at least partially leached PCD table 202 shown in FIG. 2 may be fabricated by enclosing a plurality of diamond particles with a metallic catalyst (e.g., cobalt, nickel, iron, or alloys thereof) in a pressure transmitting medium (e.g., a refractory metal can embedded in pyrophyllite or other pressure transmitting medium) to form a cell assembly and subjecting the cell assembly including the contents therein to an HPHT sintering process to sinter the diamond particles and form a PCD body comprised of bonded diamond grains that exhibit diamond-to-diamond bonding (e.g., $sp^3$ bonding) therebetween. For example, the metallic catalyst may be mixed with the diamond particles, infiltrated from a metallic catalyst foil or powder adjacent to the diamond particles, provided and infiltrated from a cemented carbide substrate (e.g., cobalt from a cobalt cemented tungsten carbide substrate), or combinations of the foregoing. The bonded diamond grains define interstitial regions, with the metallic catalyst disposed within at least a portion of the interstitial regions. The diamond particles may exhibit a single-mode diamond particle size distribution, or a bimodal or greater diamond particle size distribution. The as-sintered PCD body may be leached by immersion in an acid, such as aqua regia, nitric acid, hydrofluoric acid, mixtures of the foregoing, or subjected to another suitable process to remove at least a portion of the metallic catalyst from the interstitial regions of the PCD body and form the at least partially leached PCD table 202. For example, the as-sintered PCD body may be immersed in the acid for about 2 to about 7 days (e.g., about 3, 5, or 7 days) or for a few weeks (e.g., about 4 weeks) depending on the process employed. It is noted that when the metallic catalyst is infiltrated into the diamond particles from a cemented tungsten carbide substrate including tungsten carbide particles cemented with a metallic catalyst (e.g., cobalt, nickel, iron, or alloys thereof), the infiltrated metallic catalyst may carry a tungsten-containing material (e.g., tungsten and/or tungsten carbide) therewith and the as-sintered PCD body may include such tungsten-containing material therein disposed interstitially between the bonded diamond grains. Depending upon the leaching process, at least a portion of the tungsten-containing material may not be substantially removed by the leaching process and may enhance the wear resistance of the at least partially leached PCD table 202.

The diamond-stable HPHT sintering process conditions employed to form the as-sintered PCD body may be a temperature of at least about 1000° C. (e.g., about 1100° C. to about 2200° C., or about 1200° C. to about 1450° C.) and a pressure in the pressure transmitting medium of at least about 7.5 GPa (e.g., about 7.5 GPa to about 15 GPa, about 9 GPa to about 12 GPa, or about 10 GPa to about 12.5 GPa) for a time sufficient to sinter the diamond particles together in the presence of the metallic catalyst and form the PCD comprising directly bonded-together diamond grains defining interstitial regions occupied by the metal-solvent catalyst. For example, the pressure in the pressure transmitting medium that encloses the diamond particles and metallic catalyst source may be at least about 8.0 GPa, at least about 9.0 GPa, at least about 10.0 GPa, at least about 11.0 GPa, at least about 12.0 GPa, or at least about 14 GPa.

As the sintering pressure employed during the HPHT process used to fabricate the PCD body is moved further into the diamond-stable region away from the graphite-diamond equilibrium line, the rate of nucleation and growth of diamond increases. Such increased nucleation and growth of diamond between diamond particles (for a given diamond particle formulation) may result in the as-sintered PCD body being formed that exhibits one or more of a relatively lower metallic catalyst content, a higher coercivity, a lower specific magnetic saturation, or a lower specific permeability (i.e., the ratio of specific magnetic saturation to coercivity) than PCD formed at a lower sintering pressure.

Generally, as the sintering pressure that is used to form the PCD body increases, the coercivity of the PCD body may increase and the magnetic saturation may decrease. The PCD body defined collectively by the bonded diamond grains and the metallic catalyst may exhibit a coercivity of about 115 Oersteds ("Oe") or more and a metallic catalyst content of less than about 7.5 weight % ("wt %") as indicated by a specific magnetic saturation of about 15 Gauss·$cm^3$/grams ("G·cm$^3$/g") or less. For example, the coercivity of the PCD body may be about 115 Oe to about 250 Oe and the specific magnetic saturation of the PCD body may be greater than 0 G·cm$^3$/g to about 15 G·cm$^3$/g. In an even more detailed embodiment, the coercivity of the PCD body may be about 115 Oe to about 175 Oe and the specific magnetic saturation of the PCD body may be about 5 G·cm$^3$/g to about 15 G·cm$^3$/g. In yet an even more detailed embodiment, the coercivity of the PCD body may be about 155 Oe to about 175 Oe and the specific magnetic saturation of the PCD body may be about 10 G·cm$^3$/g to about 15 G·cm$^3$/g. The specific permeability (i.e., the ratio of specific magnetic saturation to coercivity) of the PCD may be about 0.10 or less, such as about 0.060 G·cm$^3$/Oe·g to about 0.090 G·cm$^3$/Oe·g.

As merely one example, ASTM B886-03 (2008) provides a suitable standard for measuring the specific magnetic saturation and ASTM B887-03 (2008) e1 provides a suitable standard for measuring the coercivity of the PCD. Although both ASTM B886-03 (2008) and ASTM B887-03 (2008) e1 are directed to standards for measuring magnetic properties of cemented carbide materials, either standard may be used to determine the magnetic properties of PCD. A KOERZIMAT CS 1.096 instrument (commercially available from Foerster Instruments of Pittsburgh, Pa.) is one suitable instrument that may be used to measure the specific magnetic saturation and the coercivity of the PCD.

The pressure values employed in the HPHT processes disclosed herein refer to the pressure in the pressure transmitting medium at room temperature (e.g., about 25° C.) with application of pressure using an ultra-high pressure press and not the pressure applied to the exterior of the cell assembly. The actual pressure in the pressure transmitting medium at sintering temperature may be slightly higher. The ultra-high pressure press may be calibrated at room temperature by embedding at least one calibration material that changes structure at a known pressure such as, PbTe, thallium, barium, or bismuth in the pressure transmitting medium.

Even after leaching, a residual amount of the metallic catalyst may remain in the interstitial regions between the bonded diamond grains of the at least partially leached PCD table 202 that may be identifiable using mass spectroscopy, energy dispersive x-ray spectroscopy microanalysis, or other suitable analytical technique. Such entrapped, residual metallic catalyst is difficult to remove even with extended leaching times. For example, the residual amount of metallic catalyst may be present in an amount of about 4 weight % or less, about 3 weight % or less, about 2 weight % or less, about 0.8 weight % to about 1.50 weight %, or about 0.86 weight % to about 1.47 weight %.

The at least partially leached PCD table 202 may be subjected to at least one shaping process prior to bonding to the substrate 108, such as grinding or lapping, to tailor the geometry thereof (e.g., forming an edge chamfer), as desired, for a particular application. The as-sintered PCD body may also be shaped prior to leaching or bonding to the substrate 108 by a machining process, such as electro-discharge machining.

The plurality of diamond particles sintered to form the at least partially leached PCD table 202 may exhibit one or more selected sizes. The one or more selected sizes may be determined, for example, by passing the diamond particles through one or more sizing sieves or by any other method. In an embodiment, the plurality of diamond particles may include a relatively larger size and at least one relatively smaller size. As used herein, the phrases "relatively larger" and "relatively smaller" refer to particle sizes determined by any suitable method, which differ by at least a factor of two (e.g., 40 μm and 20 μm). More particularly, in various embodiments, the plurality of diamond particles may include a portion exhibiting a relatively larger size (e.g., 100 μm, 90 μm, 80 μm, 70 μm, 60 μm, 50 μm, 40 μm, 30 μm, 20 μm, 15 μm, 12 μm, 10 μm, 8 μm) and another portion exhibiting at least one relatively smaller size (e.g., 30 μm, 20 μm, 10 μm, 15 μm, 12 μm, 10 μm, 8 μm, 4 μm, 2 μm, 1 μm, 0.5 μm, less than 0.5 μm, 0.1 μm, less than 0.1 μm). In another embodiment, the plurality of diamond particles may include a portion exhibiting a relatively larger size between about 40 μm and about 15 μm and another portion exhibiting a relatively smaller size between about 12 μm and about 2 μm. Of course, the plurality of diamond particles may also comprise three or more different sizes (e.g., one relatively larger size and two or more relatively smaller sizes), without limitation.

It should be noted that the second region 112 of the PCD table 102 in FIG. 1 may exhibit any of the foregoing magnetic characteristics as at least a portion of the interstitial regions thereof are occupied by a ferromagnetic metallic constituent, such as cobalt from the substrate 108. The high coercivity is indicative of the high strength and density of the diamond-to-diamond bonds between the diamond grains of the PCD table 102. The low magnetic saturation is indicative of a low metallic catalyst content of about 1 wt % to about 7.5 wt %, such as about 3 wt % to about 6 wt %. The magnetic characteristics of the second region 112 may be determined by removing the substrate 108 and the first region 110 via grinding, electro-discharge machining, or another suitable material removal process and magnetically testing the isolated second region 112 of the PCD table 102.

Figure 3:
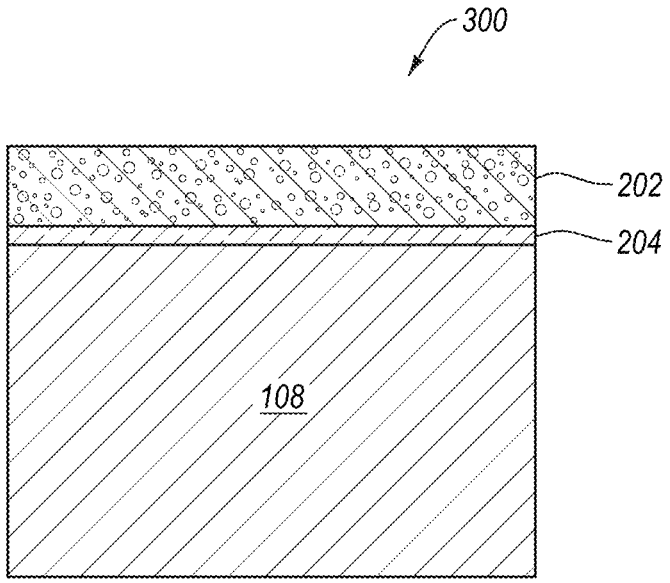
FIG. 3 is a cross-sectional view of an assembly to be HPHT processed to form the PDC shown in FIG. 1 according to another embodiment of method.

FIG. 3 is a cross-sectional view of an assembly 300 to be HPHT processed to form the PDC shown in FIG. 1 according to another embodiment of method. The at least one layer 204 including the at least one low-carbon-solubility material therein may be positioned between the at least partially leached PCD table 202 and the substrate 108 to form the assembly 300. The assembly 300 may be enclosed in a suitable pressure transmitting medium and subjected to an HPHT process to form the PDC 100 (FIG. 1) using the same or similar HPHT conditions previously discussed with respect to HPHT processing the assembly 200 shown in FIG. 2.

Figure 4A:
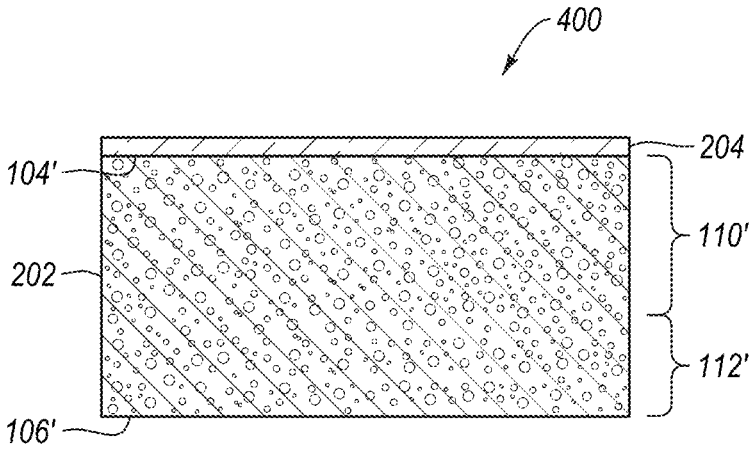
FIGS. 4A and 4B are cross-sectional views at different stages during another embodiment of a method for fabricating the PDC shown in FIG. 1.
Figure 4B:
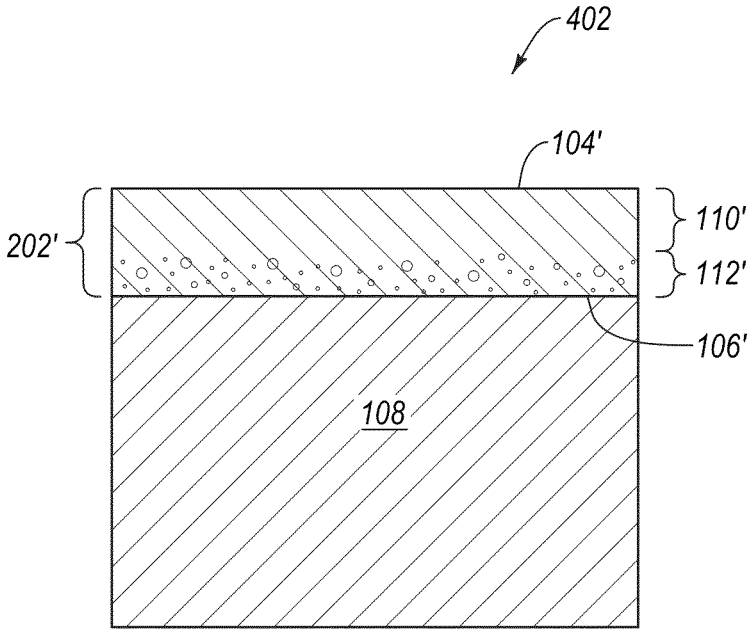

FIGS. 4A and 4B are cross-sectional views at different stages during another embodiment of a method for fabricating the PDC 100 shown in FIG. 1. Referring to FIG. 4A, the at least partially leached PCD table 202 may be provided that includes the upper surface 104' and the back surface 106'. The least one layer 204 including the at least one low-carbon-solubility material therein may be positioned adjacent to the upper surface 104' to form the assembly 400, such as by coating the upper surface 104' with the at least one layer 204 and/or disposing the at least one layer 204 in the bottom of a container and placing the at least partially leached PCD table 202 in the container and in contact with the at least one layer 204.

The assembly 400 may be enclosed in a suitable pressure transmitting medium to form a cell assembly and subjected to an HPHT process using the HPHT conditions used to HPHT process the assembly 200 shown in FIG. 2. During the HPHT process, the at least one low-carbon-solubility material of the at least one layer 204 may partially or substantially completely melt and infiltrate into at least a portion of the interstitial regions of the first region 110' of the at least partially leached PCD table 202 to form a partially infiltrated PCD table 202' (FIG. 4B). The volume of the at least one low-carbon-solubility material may be selected so that it is sufficient to only fill the interstitial regions of the selected first region 110'. Thus, the interstitial regions of the second region 112' are not infiltrated with the at least one low-carbon-solubility material and, thus, are substantially free of the at least one low-carbon-solubility material.

In another embodiment, when the at least one low-carbon-solubility material in the at least one layer 204 melts or begins melting at a sufficiently low temperature so the infiltration can be performed without significantly damaging the diamond grains of the at least partially leached PCD table 202, the at least one low-carbon-solubility material may be infiltrated into the at least partially leached PCD table 202 under atmospheric pressure conditions or in a hot-isostatic pressing ("HIP") process. For example, one suitable at least one low-carbon-solubility material may comprise a eutectic or near eutectic (e.g., hypereutectic or hypoeutectic) mixture or alloy of aluminum and silicon.

Referring to FIG. 4B, the back surface 106' of the partially infiltrated PCD table 202' may be positioned adjacent to the substrate 108 to form an assembly 402. The assembly 402 may be subjected to an HPHT process using the HPHT conditions used to HPHT process the assembly 200 shown in FIG. 2. During the HPHT process, the metallic cementing constituent present in the substrate 108 may liquefy, and infiltrate into and occupy at least a portion of the interstitial regions of the second region 112'. Upon cooling from the HPHT process, the metallic cementing constituent forms a strong metallurgical bond between the substrate 108 and the second region 112'.

Figure 5A:
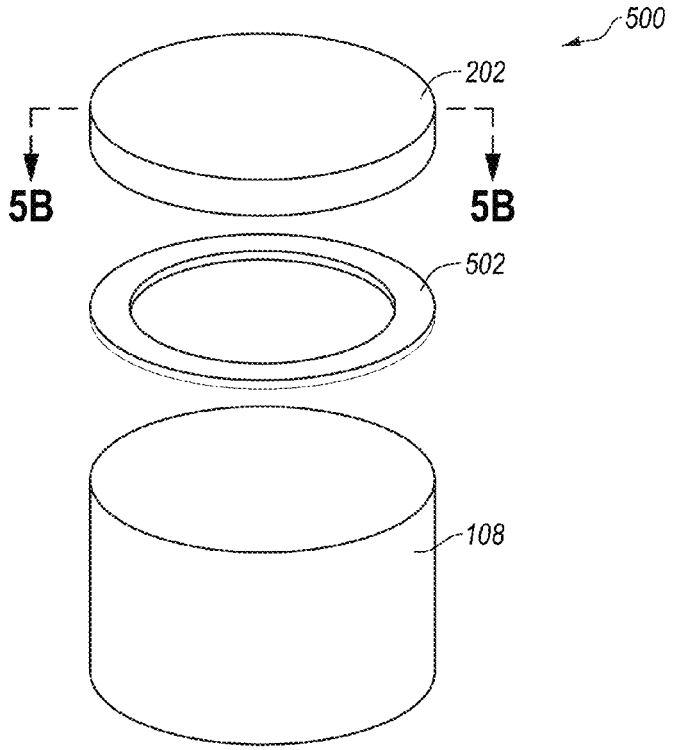
FIG. 5A is an exploded isometric view of an assembly to be HPHT processed to form a PDC including a PCD table that is infiltrated with at least one low-carbon-solubility material in selective locations according to an embodiment of method.
Figure 5B:
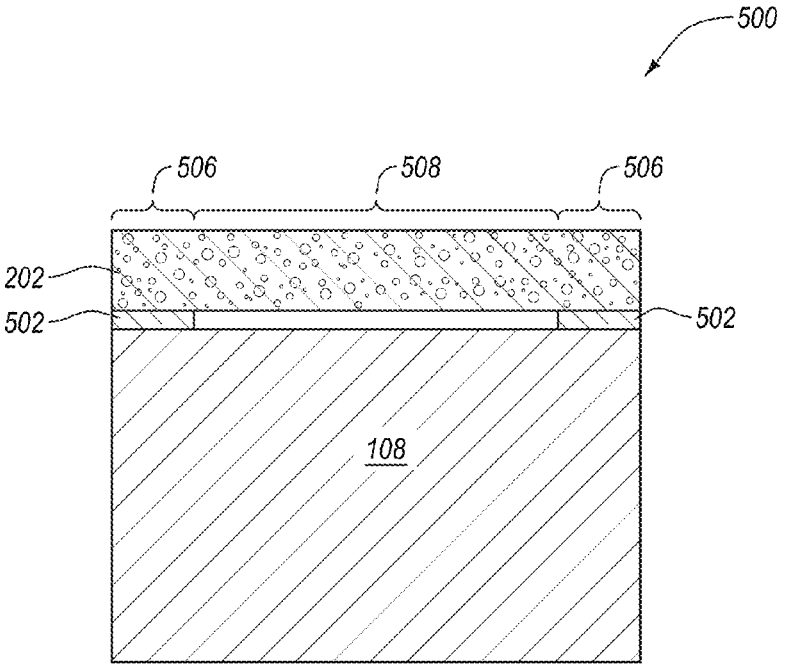
FIG. 5B is a cross-sectional view of the assembly shown in FIG. 5A taken along line 5B-5B.

In other embodiments, the at least partially leached PCD table 202 may be selectively infiltrated with at least one low-carbon-solubility material to provide a thermally-stable cutting edge region while a metallic constituent may be infiltrated in other regions of the at least partially leached PCD table 202 to provide a strong bond with the substrate 108. FIGS. 5A and 5B are exploded isometric and cross-sectional views of an assembly 500 to be HPHT processed to form a PDC including a PCD table that is infiltrated with at least one low-carbon-solubility material in selective locations according to an embodiment of method. The assembly 500 includes a thin ring 502 or other annular structure made from one or more of the low-carbon-solubility materials disclosed herein. The thin ring 502 is disposed between the at least partially leached PCD table 202 and the substrate 108. However, in another embodiment shown in FIG. 5E, the at least partially leached PCD table 202 may be disposed between the thin ring 502 and the substrate 108. The assembly 500 may be subjected to an HPHT process using the same or similar HPHT conditions used to process the assembly 200 shown in FIG. 2.

Figure 5C:
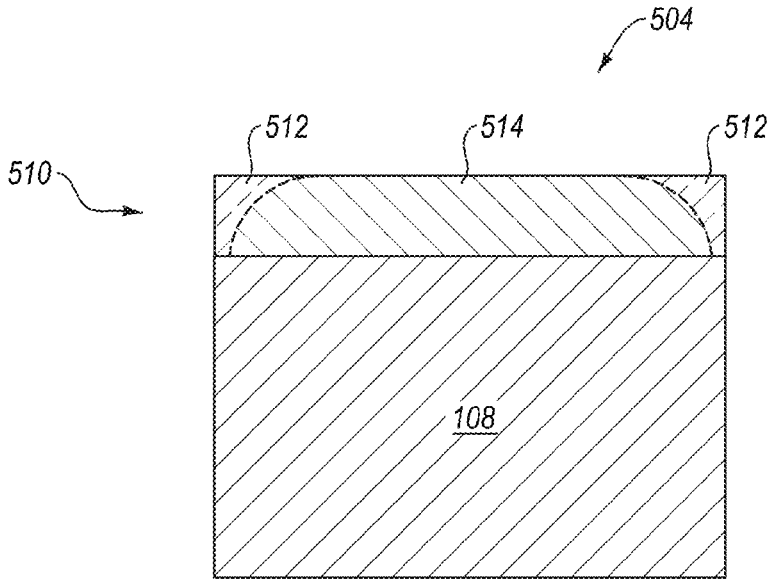
FIG. 5C is a cross-sectional view of the PDC formed by HPHT processing the assembly shown in FIGS. 5A and 5B.
Figure 5D:
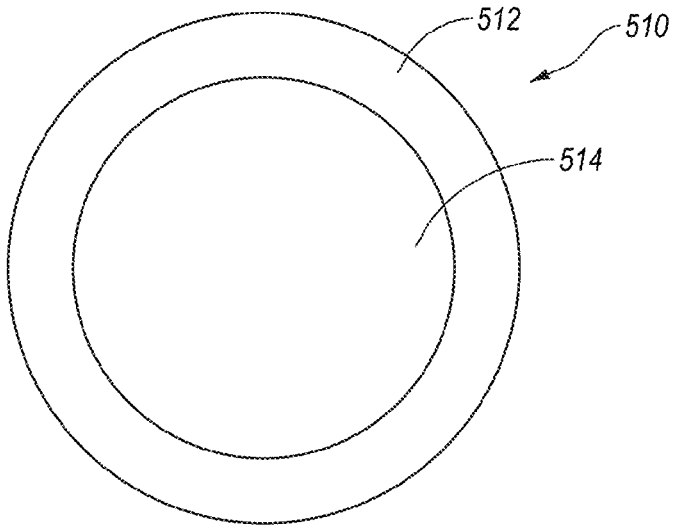
FIG. 5D is a top plan view of the infiltrated PCD table of the PDC shown in FIG. 5C.
Figure 5E:
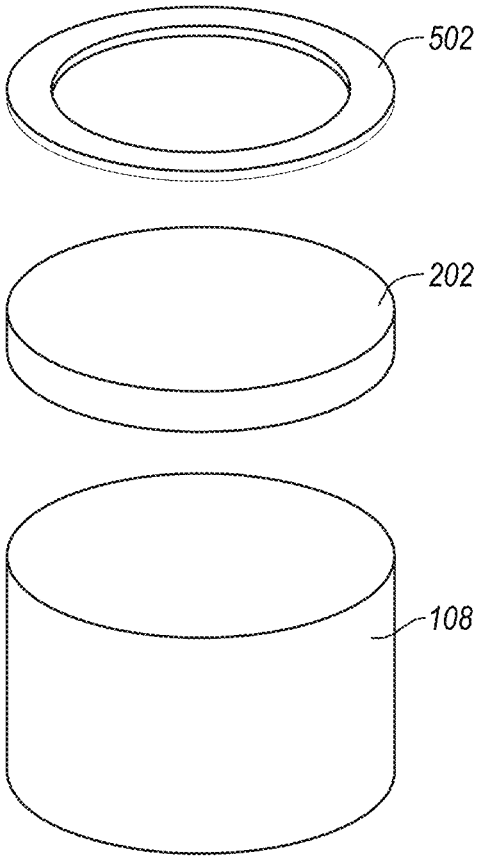
FIG. 5E is an exploded isometric view of an assembly to be HPHT processed to form a PDC, which is similar to the assembly shown in FIG. 5A, but the at least partially leached PCD table is disposed between the thin ring of the at least one low-carbon-solubility material and the substrate according to another embodiment of method.

FIG. 5C is a cross-sectional view of a PDC 504 formed by HPHT processing the assembly 500 and FIG. 5D is a top plan view. During the HPHT process, the thin ring 502 liquefies and infiltrates into a generally annular region 506 (FIG. 5B) of the at least partially leached PCD table 202. During the HPHT process, a metallic cementing constituent (e.g., cobalt) from the substrate 108 also infiltrates into a core region 508 (FIG. 5B) of the at least partially leached PCD table 202. In some embodiments, the thin ring 502 liquefies before the metallic cementing constituent and, thus, the metallic cementing constituent infiltrates the core region 508 after the at least one low-carbon-solubility material infiltrates into the generally annular region 506. However, in other embodiments, the metallic cementing constituent may infiltrate at substantially the same time as the at least one low-carbon-solubility material. The infiltrated metallic cementing constituent provides a strong metallurgical bond between a PCD table 510 so-formed and the substrate 108. The PCD table 510 so-formed includes a thermally-stable cutting region 512 exhibiting a generally annular configuration that includes the infiltrated at least one low-carbon-solubility material provided from the thin ring 502, and a core region 514 that includes the infiltrated metallic cementing constituent.

Figure 6A:
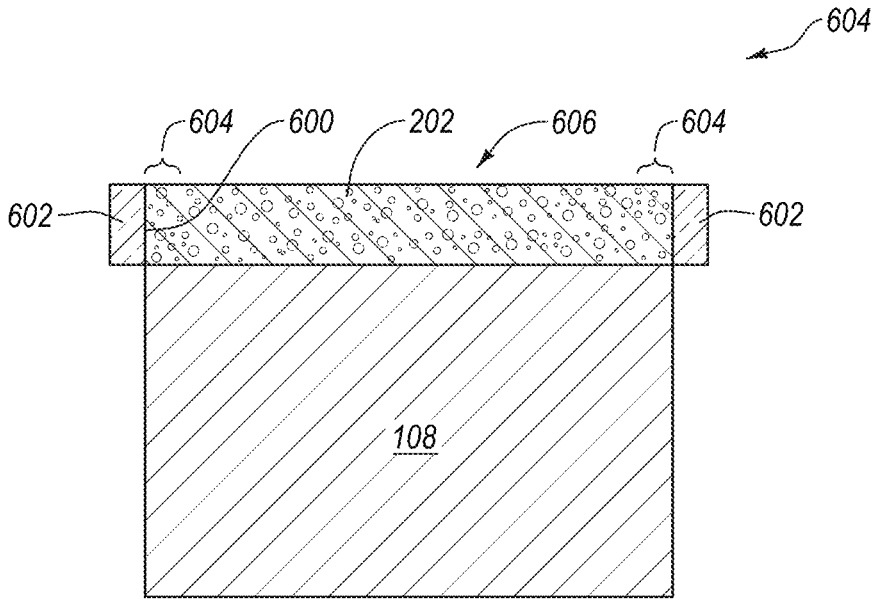
FIG. 6A is a cross-sectional view of an assembly to be HPHT processed to form a PDC including a PCD table that is partially infiltrated from a side thereof with at least one low-carbon-solubility material according to another embodiment of method.

Referring to FIG. 6A, in other embodiments, the at least partially leached PCD table 202 may be infiltrated with the at least one low-carbon-solubility material from at least one lateral surface 600 thereof. In such an embodiment, a ring 602 may be disposed about the at least partially leached PCD table 202, and the assembly of the ring 602 and the at least partially leached PCD table 202 may be positioned adjacent to the interfacial surface 106 of the substrate 108 to form an assembly 604. The assembly 604 may be subjected to an HPHT process using the same or similar HPHT conditions used to process the assembly 200 shown in FIG. 2.

During the HPHT process, the ring 602 liquefies and infiltrates through the at least one lateral surface 600 and into a generally annular region 604 of the at least partially leached PCD table 202. During the HPHT process, a metallic cementing constituent from the substrate 108 also infiltrates into a core region 606 of the at least partially leached PCD table 202. In some embodiments, the ring 602 liquefies before the metallic cementing constituent and, thus, the metallic cementing constituent infiltrates the core region 606 after the at least one low-carbon-solubility material infiltrates into the generally annular region 604. However, in other embodiments, the metallic cementing constituent may infiltrate at substantially the same time as the at least one low-carbon-solubility material.

Figure 6B:
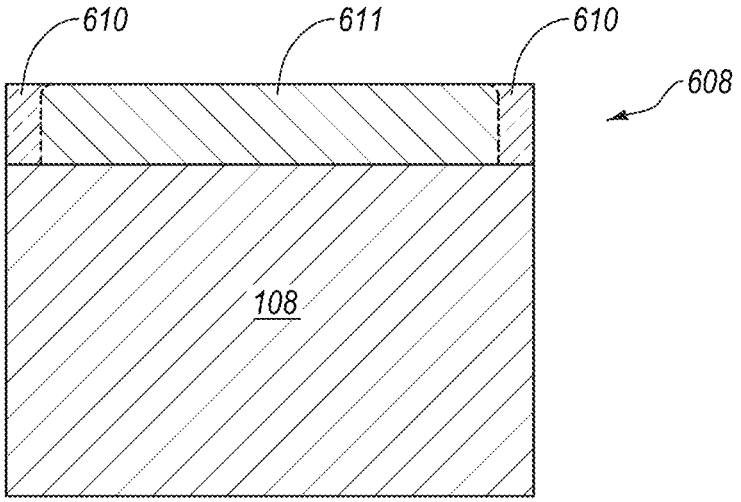
FIG. 6B is a cross-sectional view of the PDC formed by HPHT processing the assembly shown in FIG. 6A.

Referring to FIG. 6B, the infiltrated metallic cementing constituent provides a strong metallurgical bond between a PCD table 608 so-formed and the substrate 108. The PCD table 608 so-formed includes a thermally-stable cutting region 610 exhibiting a generally annular configuration that includes the infiltrated at least one low-carbon-solubility material provided from the ring 602, and a core region 611 including the infiltrated metallic cementing constituent.

Figure 6C:
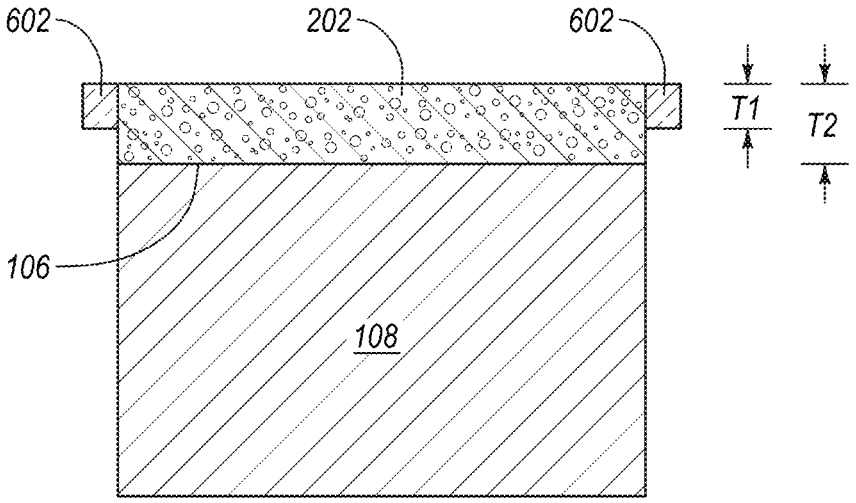
FIG. 6C is a cross-sectional view of an assembly to be HPHT processed to form a PDC including a PCD table that is partially infiltrated from the side with at least one low-carbon-solubility material according to yet another embodiment of method.
Figure 6D:
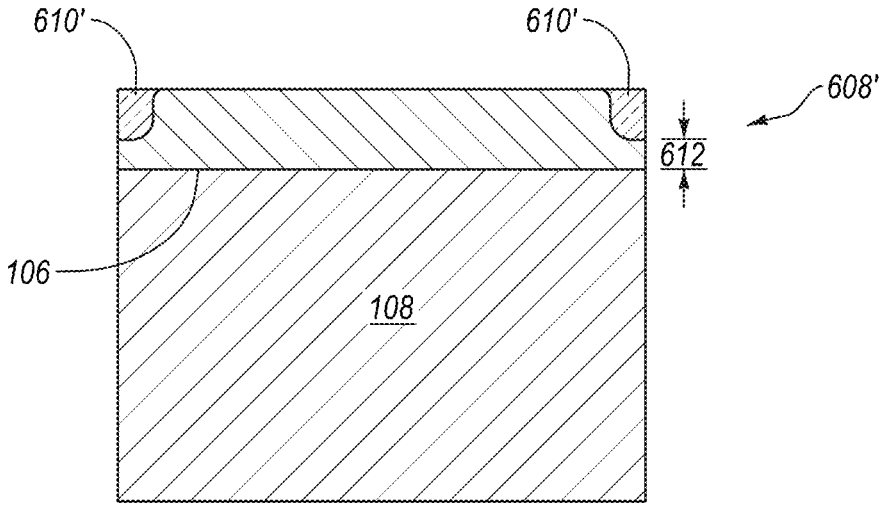
FIG. 6D is a cross-sectional view of the PDC formed by HPHT processing the assembly shown in FIG. 6C.

Referring to FIG. 6C, in some embodiments, the ring 602 may exhibit a thickness T1 that is dimensioned to be less than that of a thickness T2 of the at least partially leached PCD table 202. Referring to FIG. 6D, after HPHT process of the assembly shown in FIG. 6C, a PCD table 608' so-formed includes a thermally-stable cutting region 610' that does not extend the total thickness T2 of the PCD table 608'. Rather, the thermally-stable cutting region 610' only extends part of the thickness of the PCD table 608' and has a standoff 612 from the interfacial surface 106 of the substrate 108.

Figure 6E:
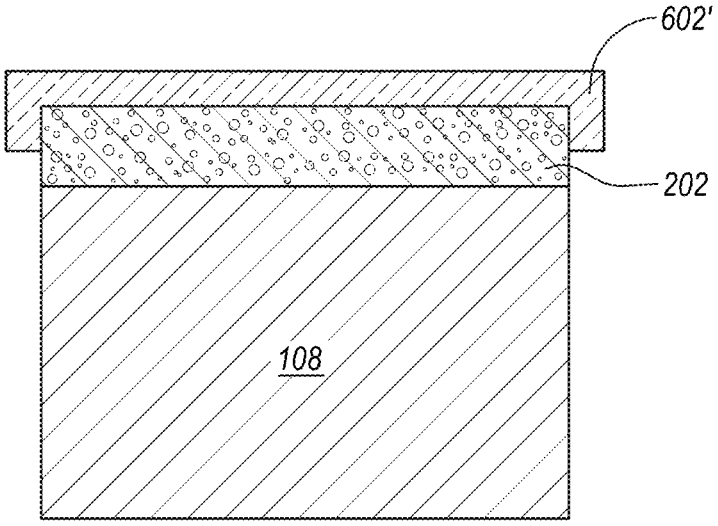
FIG. 6E is a cross-sectional view of an assembly to be HPHT processed to form a PDC including a PCD table with a cap-like structure including the at least one low-carbon-solubility material therein according to an embodiment.
Figure 6F:
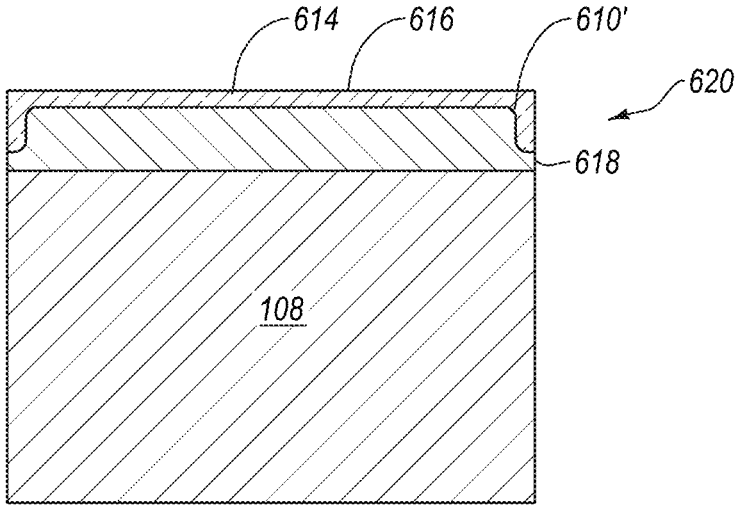
FIG. 6F is a cross-sectional view of the PDC formed by HPHT processing the assembly shown in FIG. 6E.

In other embodiments, a cap-like structure including the at least one low-carbon-solubility material may be formed. Referring to FIG. 6E, a receptacle 602' made from the at least one low-carbon-solubility material may be placed over the upper surface 104' of the at least partially leached PCD table 202. As shown in FIG. 6F, after HPHT processing, the at least one low-carbon-solubility material infiltrates the at least partially leached PCD table 202 to form a cap-like structure 614 that extends along an upper surface 616 and lateral surface 618 of infiltrated PCD table 620 so-formed. Depending upon the geometry of the receptacle 602', the cap-like structure 614 may extend along only part of the length of the lateral surface 618 or along substantially the entire length of the lateral surface 618 so that there is no standoff from the interfacial surface 106 of the substrate 108 to which the infiltrated PCD table 620 is bonded.

Figure 7A:
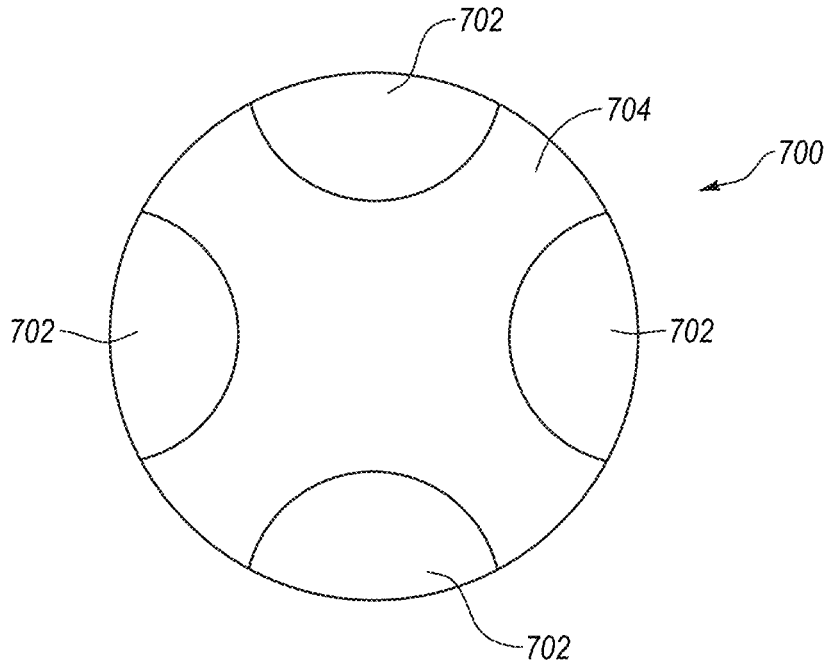
FIG. 7A is a top plan view of an infiltrated PCD table of a PDC that is selectively infiltrated with the at least one low-carbon-solubility material in a plurality of discrete locations according to an embodiment.

A variety of other thermally-stable cutting region configurations may be formed besides those illustrated in FIGS. 5C, 6B, and 6D. FIG. 7A is a top plan view of a PCD table 700 that is selectively infiltrated with the at least one low-carbon-solubility material in multiple discrete locations to form a plurality of thermally-stable cutting regions 702 according to another embodiment. A main region 704 may be infiltrated with a metallic cementing constituent from the substrate 108 (not shown). The plurality of thermally-stable cutting regions 702 may be formed, for example, by dividing the thin ring 502 (FIGS. 5A and 5B) into discrete sections that are placed between the at least partially leached PCD table 202 and the substrate 108 and circumferentially spaced from each other. Alternatively, the discrete sections may be placed adjacent to an upper surface of the at least partially leached PCD table 202.

Figure 7B:
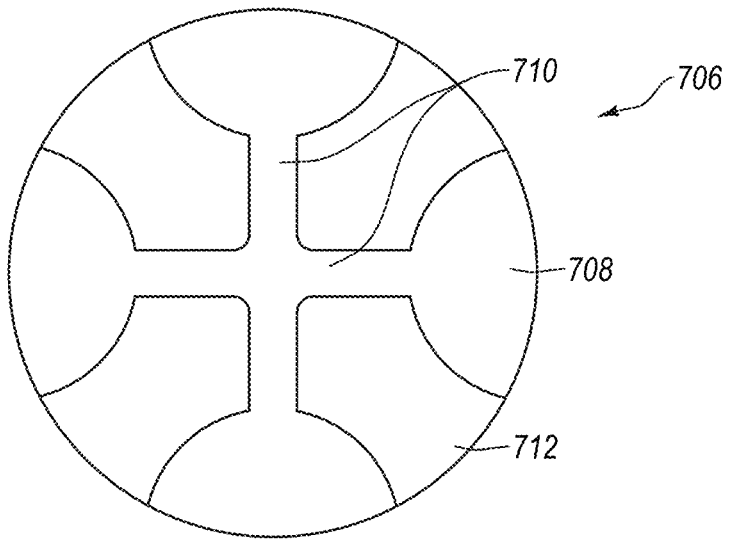
FIG. 7B is a top plan view of an infiltrated PCD table of a PDC that is selectively infiltrated with the at least one low-carbon-solubility material in a plurality of discrete locations according to another embodiment.

FIG. 7B is a top plan view of an infiltrated PCD table 706 that is selectively infiltrated with the at least one low-carbon-solubility material in multiple discrete locations to form a plurality of thermally-stable cutting regions 708 according to another embodiment. The plurality of thermally-stable cutting regions 708 are interconnected by a network of radially-extending branches 710. A region 712 extending about the plurality of thermally-stable cutting regions 708 and the branches 710 may be infiltrated with a metallic cementing constituent from the substrate 108 (not shown). The plurality of thermally-stable cutting regions 708 and the branches 710 may be formed by cutting, stamping, or machining a substantially correspondingly shaped structure from a thin disc made from the at least one low-carbon-solubility material.

Figure 8A:
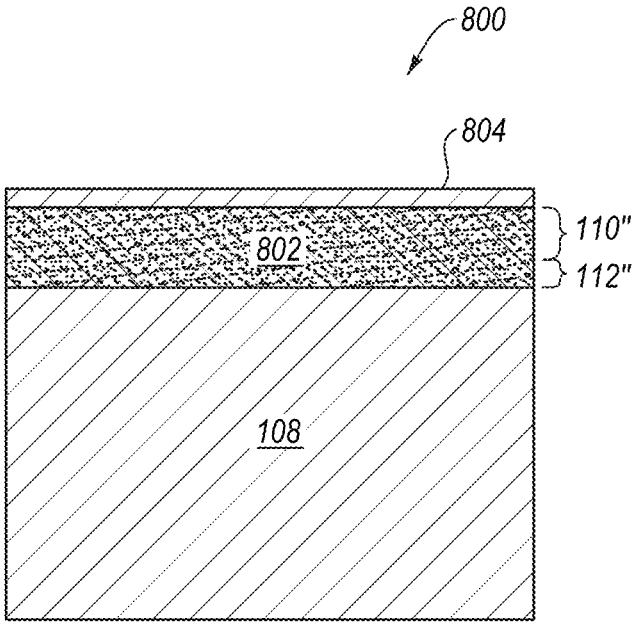
FIG. 8A is a cross-sectional view of an assembly to be HPHT processed to form the PDC shown in FIG. 1 in a single-step HPHT process according to another embodiment of method.

In other embodiments, the PCD table 102 of the PDC 100 may be integrally formed with the substrate 108 in a single-step HPHT process. For example, FIG. 8A is a cross-sectional view of an assembly 800 to be processed under HPHT conditions to form the PDC 100 shown in FIG. 1 in a single-step HPHT process according to an embodiment of a method. The assembly 800 includes a plurality of diamond particles 802 positioned between the substrate 108 and a carbon source 804. The plurality of diamond particles 802 may exhibit any of the diamond particle sizes and distributions disclosed herein.

The carbon source 804 includes one or more of the at least one low-carbon-solubility materials implanted with carbon ions. In an embodiment, the carbon source 804 includes a thin disc of one or more of the at least one low-carbon-solubility materials implanted with carbon ions. In another embodiment, the carbon source 804 includes a plurality of particles made from one or more of the at least one low-carbon-solubility materials implanted with carbon ions. For example, the plurality of particles may be made from the same low-carbon-solubility material or a mixture of two or more types of particles made from different types of low-carbon-solubility materials.

The carbon source 804 may be formed by directing a plurality of carbon ions at the one or more of the at least one low-carbon-solubility materials to implant the carbon ions therein. The dose and implantation energy of the carbon ions implanted may be sufficient to at least saturate or supersaturate the one or more of the at least one low-carbon-solubility materials with the carbon ions. As disclosed herein, the solubility of carbon in the at least one low-carbon-solubility material may be very low at room temperature. Therefore, the carbon ions may be in solution in the one or more of the at least one low-carbon-solubility materials in a metastable state.

In an embodiment, a plasma that includes the carbon ions may be generated from a carbon-containing gas using electron cyclotron resonance ("ECR"), a large-area pulsed radio frequency, or another suitable technique. For example, the carbon ions may be generated by discharge of a carbon-containing gas, such as carbon monoxide, carbon dioxide, methane, another type of hydrocarbon gas, or mixtures of the foregoing; or sputter erosion of carbon electrode using a plasma, such as an argon plasma. The carbon ions may be accelerated at the one or more of the at least one low-carbon-solubility materials using a high-voltage source so that the carbon ions become embedded therein. For example, the carbon ions may be accelerated at the one or more of the at least one low-carbon-solubility materials with an energy of about 2 keV to about 50 keV. In some embodiments, the carbon ions may be in the form of a high-energy beam of carbon ions that may be directed at the one or more of the at least one low-carbon-solubility materials. For example, the high-energy beam of carbon ions may exhibit an energy of about 70 keV to about 100 keV. The dose of the carbon ions implanted into the one or more of the at least one low-carbon-solubility materials may be about $10^{15}$ ions per $cm^2$ to about $10^{18}$ ions per $cm^2$, such as about $10^{16}$ ions per $cm^2$ to about $10^{17}$ ions per $cm^2$ or about $10^{17}$ ions per $cm^2$ or more. In an embodiment, the one or more of the at least one low-carbon-solubility materials may be implanted with carbon ions in sequentially applied doses each of which has a lower implantation energy to thereby stack the carbon ions.

The assembly 800 may be placed in a pressure transmitting medium, such as a refractory metal can embedded in pyrophyllite or other pressure transmitting medium, to form a cell assembly. The cell assembly, including the assembly 800 therein, may be subjected to an HPHT process using an ultra-high pressure press to create temperature and pressure conditions at which diamond is stable. The temperature of the HPHT process may be at least about 1000° C. (e.g., about 1200° C. to about 1600° C., or about 1200° C. to about 1300° C.) and the pressure of the HPHT process may be at least 4.0 GPa (e.g., about 5.0 GPa to about 10.0 GPa, or about 5.0 GPa to about 8.0 GPa) for a time sufficient to at least partially melt and infiltrate the plurality of diamond particles 802 with the one or more of the at least one low-carbon-solubility materials implanted with carbon ions from the carbon source 804 and the metallic cementing constituent from the substrate 108.

During the HPHT process, the one or more of the at least one low-carbon-solubility materials implanted with carbon ions from the carbon source 804 at least partially melts and infiltrates into a first region 110" of the plurality of diamond particles 802 carrying carbon prior to or substantially simultaneously with the metallic cementing constituent from the substrate 108 infiltrating into a second region 112" of the plurality of diamond particles 802 that is located adjacent to the substrate 108. The one or more of the at least one low-carbon-solubility materials from the carbon source 804 infiltrates into the plurality of diamond particles 802 generally to a selected depth and the implanted carbon ions precipitate as diamond under the diamond-stable HPHT conditions. Thus, the one or more of the at least one low-carbon-solubility materials implanted with carbon ions may carry such carbon ions that precipitate to form diamond-to-diamond bonds between the plurality of diamond particles 802 to form first region 110 of the sintered PCD table 102 (FIG. 1). The amount of the at least one low-carbon-solubility material in the carbon source 804 may be selected so that it only infiltrates into the first region 110" to the selected depth. The HPHT conditions are also sufficient to at least partially melt the metallic cementing constituent present in the substrate 108 (e.g., cobalt in a cobalt-cemented tungsten carbide substrate), which infiltrates into the interstitial regions of the second region 112" of the plurality of diamond particles 802 to catalyze formation of PCD therefrom. However, the depth of infiltration of the metallic cementing constituent from the substrate 108 may be limited by the presence of the at least one low-carbon-solubility material in the first region 110".

Upon cooling from the HPHT process, the infiltrated metallic cementing constituent forms a strong metallurgical bond between the PCD table 102 (FIG. 1) so-formed and the substrate 108.

In another embodiment, the carbon source 804 may be positioned between the substrate 108 and the plurality of diamond particles 802 to form an assembly. The assembly so-formed may be enclosed in a suitable pressure transmitting medium to form a cell assembly and subjected to an HPHT process to form the PDC 100 (FIG. 1) using the same or similar HPHT conditions previously discussed with respect to HPHT processing the assembly 800 shown in FIG. 8A.

Figure 8B:
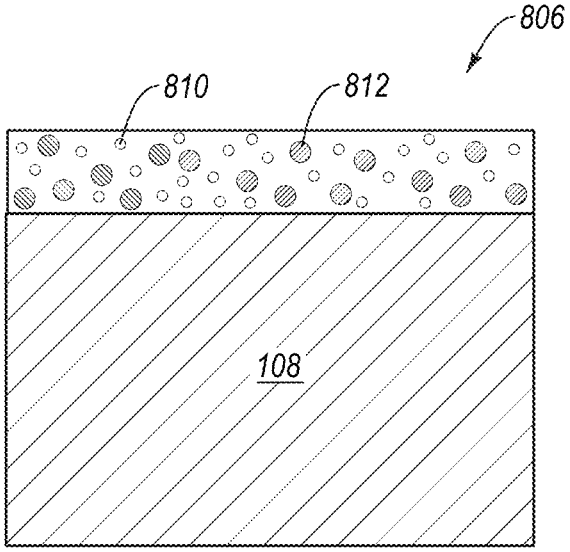
FIG. 8B is a cross-sectional view of an assembly to be HPHT processed to form the PDC shown in FIG. 1 in a single-step HPHT process according to another embodiment of method.

FIG. 8B is a cross-sectional view of an assembly 806 to be processed under HPHT conditions to form the PDC 100 shown in FIG. 1 in a single-step HPHT process according to an embodiment of a method. The assembly 806 includes a mixture of diamond particles 810 and carbon-source particles 812 made from at least one low-carbon-solubility material implanted with carbon ions. For example, the diamond particles 810 may exhibit any of the disclosed diamond particle size and distributions disclosed herein and the at least one low-carbon-solubility material may be chosen from any of the at least one low-carbon-solubility materials disclosed herein or combinations thereof. The carbon-source particles 812 may be formed by implanting particles made from the at least one low-carbon-solubility material with carbon ions using any of the implantation techniques disclosed herein. The assembly 806 may be enclosed in a suitable pressure transmitting medium and subjected to an HPHT process to form the PDC 100 (FIG. 1) using the same or similar HPHT conditions previously discussed with respect to HPHT processing the assembly 800 shown in FIG. 8A.

Figure 9:
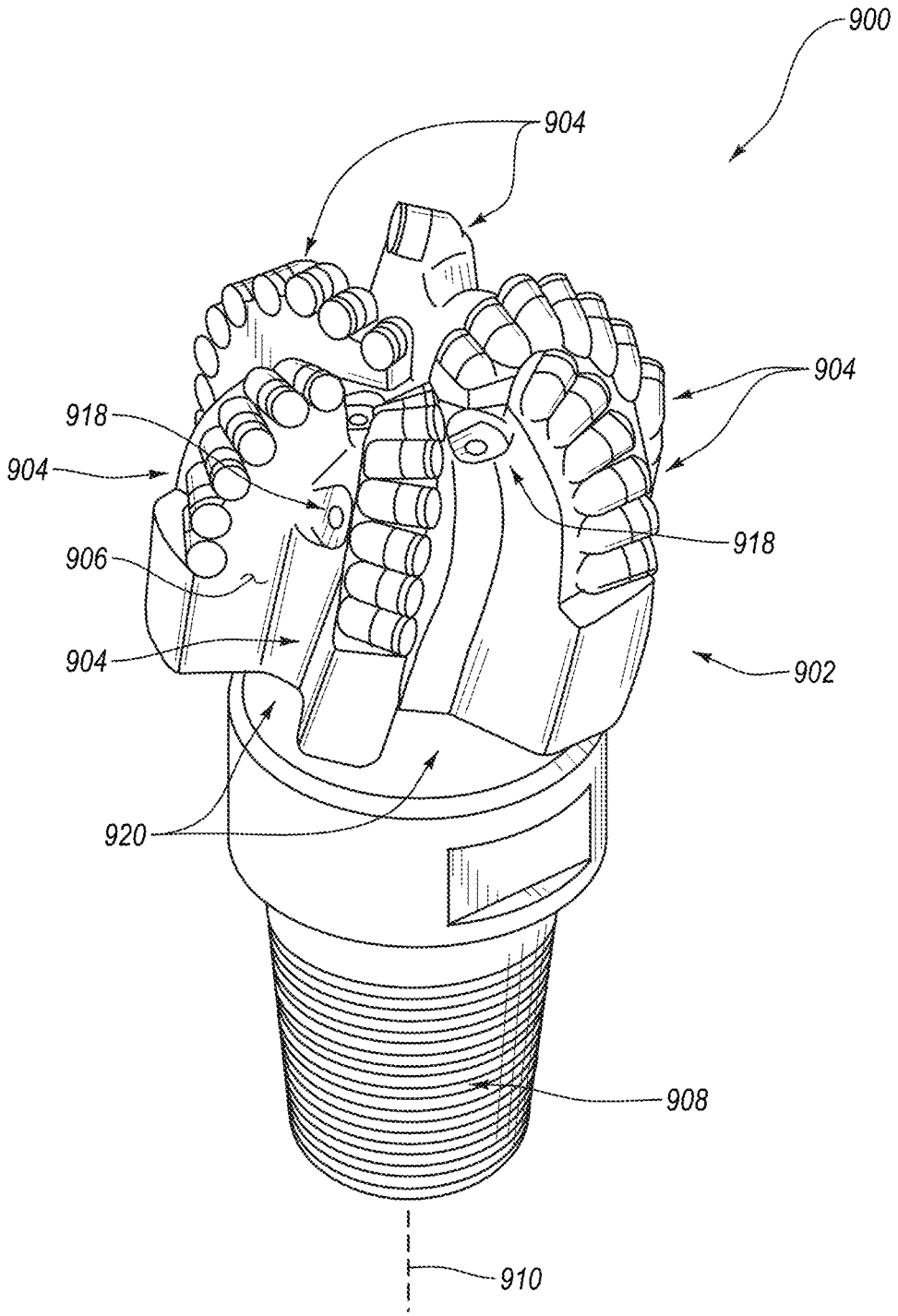
FIG. 9 is an isometric view of an embodiment of a rotary drill bit that may employ one or more of the disclosed PDC embodiments.
Figure 10:
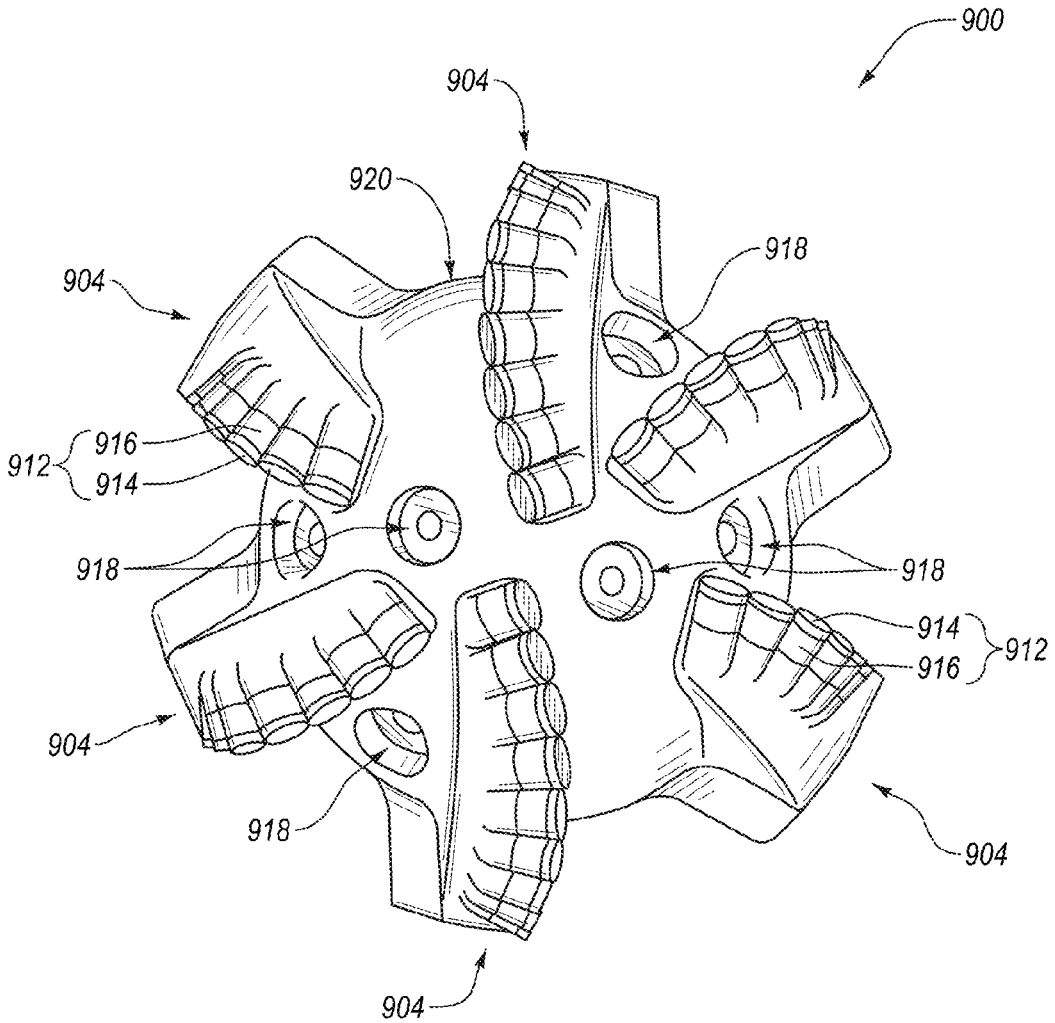
FIG. 10 is a top elevation view of the rotary drill bit shown in FIG. 9.

FIG. 9 is an isometric view and FIG. 10 is a top elevation view of an embodiment of a rotary drill bit 900 that includes at least one PDC configured and/or made according to any of the disclosed PDC embodiments. The rotary drill bit 900 includes a bit body 902 that includes radially and longitudinally extending blades 904 having leading faces 906, and a threaded pin connection 908 for connecting the bit body 902 to a drilling string. The bit body 902 defines a leading end structure for drilling into a subterranean formation by rotation about a longitudinal axis 910 and application of weight-on-bit. At least one PDC, configured and/or made according to any of the disclosed PDC embodiments, may be affixed to the bit body 902. With reference to FIG. 10, each of a plurality of PDCs 912 are secured to the blades 904 of the bit body 902 (FIG. 9). For example, each PDC 912 may include a PCD table 914 bonded to a substrate 916. More generally, the PDCs 912 may comprise any PDC disclosed herein, without limitation. In addition, if desired, in some embodiments, a number of the PDCs 912 may be conventional in construction. Also, circumferentially adjacent blades 904 define so-called junk slots 920 therebetween. Additionally, the rotary drill bit 900 includes a plurality of nozzle cavities 918 for communicating drilling fluid from the interior of the rotary drill bit 900 to the PDCs 912.

FIGS. 9 and 10 merely depict one embodiment of a rotary drill bit that employs at least one PDC fabricated and structured in accordance with the disclosed embodiments, without limitation. The rotary drill bit 900 is used to represent any number of earth-boring tools or drilling tools, including, for example, core bits, roller-cone bits, fixed-cutter bits, eccentric bits, bicenter bits, reamers, reamer wings, or any other downhole tool including superabrasive compacts, without limitation.

The PDCs disclosed herein (e.g., PDC 100 of FIG. 1) may also be utilized in applications other than cutting technology. For example, the disclosed PDC embodiments may be used in wire dies, bearings, artificial joints, inserts, cutting elements, and heat sinks. Thus, any of the PDCs disclosed herein may be employed in an article of manufacture including at least one superabrasive element or compact.

Thus, the embodiments of PDCs disclosed herein may be used in any apparatus or structure in which at least one conventional PDC is typically used. In one embodiment, a rotor and a stator, assembled to form a thrust-bearing apparatus, may each include one or more PDCs (e.g., PDC 100 of FIG. 1) configured according to any of the embodiments disclosed herein and may be operably assembled to a downhole drilling assembly. U.S. Pat. Nos. 4,410,054; 4,560,014; 5,364,192; 5,368,398; and 5,480,233, the disclosure of each of which is incorporated herein, in its entirety, by this reference, disclose subterranean drilling systems within which bearing apparatuses utilizing superabrasive compacts disclosed herein may be incorporated. The embodiments of PDCs disclosed herein may also form all or part of heat sinks, wire dies, bearing elements, cutting elements, cutting inserts (e.g., on a roller-cone-type drill bit), machining inserts, or any other article of manufacture as known in the art. Other examples of articles of manufacture that may use any of the PDCs disclosed herein are disclosed in U.S. Pat. Nos. 4,811,801; 4,268,276; 4,468,138; 4,738,322; 4,913,247; 5,016,718; 5,092,687; 5,120,327; 5,135,061; 5,154,245; 5,180,022; 5,460,233; 5,544,713; and 6,793,681, the disclosure of each of which is incorporated herein, in its entirety, by this reference.

The following working examples set forth various formulations and methods for forming PDCs. In the following working examples, the thermal stability of conventional comparative working examples 1 through 3 are compared to the thermal stability of working examples 4 through 13 according to embodiments of the invention.

Comparative Examples 1 and 2

Two conventional PDCs were obtained that were fabricated by placing a layer of diamond particles having an average particle size of about 19 μm adjacent to a cobalt-cemented tungsten carbide substrate. The layer and substrate were placed in a container assembly. The container assembly, including the layer and substrate therein, were subjected to HPHT conditions in an HPHT press at a temperature of about 1400° C. and a pressure of about 5 GPa to about 8 GPa to form a conventional PDC including a PCD table integrally formed and bonded to the cobalt-cemented tungsten carbide substrate. Cobalt was infiltrated into the layer of diamond particles from the cobalt-cemented tungsten carbide substrate catalyzing formation of the PCD table. The nominal thickness of the PCD table of the PDC was about 2.286 mm and an about 45 degree, 0.3048-mm nominal chamfer was machined in the PCD table.

The thermal stability of the PCD table of comparative examples 1 and 2 was evaluated by measuring the distance cut in a Barre granite workpiece prior to failure, without using coolant, in a vertical turret lathe test. The distance cut is considered representative of the thermal stability of the PCD table. The test parameters were a depth of cut for the PDC of about 1.27 mm, a back rake angle for the PDC of about 20 degrees, an in-feed for the PDC of about 1.524 mm/rev, a cutting speed of the workpiece to be cut of about 1.78 msec, and the workpiece had an outer diameter of about 914 mm and an inner diameter of about 254 mm. The conventional PCD tables of the PDCs of comparative examples 1 and 2 were able to cut a distance of about 2576 and 3308 linear feet, respectively, in the workpiece prior to failure.

Comparative Example 3

A PDC was obtained, which was fabricated as performed in comparative examples 1 and 2. The nominal thickness of the PCD table of the PDC was about 2.286 mm and an about 45 degree, 0.3048-mm nominal chamfer was machined in the PCD table. Then, the PCD table was acid leached after machining to a depth of about 200 μm.

The thermal stability of the PCD table of comparative example 3 was evaluated by measuring the distance cut prior to failure in the same workpiece used to test comparative examples 1 and 2 and using the same test parameters, without using coolant, in a vertical turret lathe test. The conventional PCD table of the PDC of comparative example 3 was able to cut a distance of about 4933 linear feet in the workpiece prior to failure.

Examples 4 and 5

Two PDCs were formed according to the following process. A PCD table was formed by HPHT sintering, in the presence of cobalt, diamond particles having an average grain size of about 19 μm. The PCD table included bonded diamond grains, with cobalt disposed within interstitial regions between the bonded diamond grains. The PCD table was leached with acid for a time sufficient to remove substantially all of the cobalt from the interstitial regions to form an at least partially leached PCD table. The at least partially leached PCD table was placed adjacent to a cobalt-cemented tungsten carbide substrate. A layer of copper was placed adjacent to the at least partially leached PCD table on a side thereof opposite the cobalt-cemented tungsten carbide substrate. The at least partially leached PCD table, cobalt-cemented tungsten carbide substrate, and layer of copper were placed in a container assembly and HPHT processed in a high-pressure cubic press at a temperature of about 1400° C. and a pressure of about 5 GPa to about 8 GPa to form a PDC comprising an infiltrated PCD table bonded to the cobalt-cemented tungsten carbide substrate. During the HPHT process, copper from the layer of copper infiltrated an upper region of the PCD table and cobalt from the cobalt-cemented tungsten carbide substrate infiltrated a lower region of the PCD table adjacent the cobalt-cemented tungsten carbide substrate. The copper-infiltrated PCD table had a thickness of about 2.286 mm and an about 45 degree, 0.3048-mm nominal chamfer was machined in the infiltrated PCD table.

Figure 11:
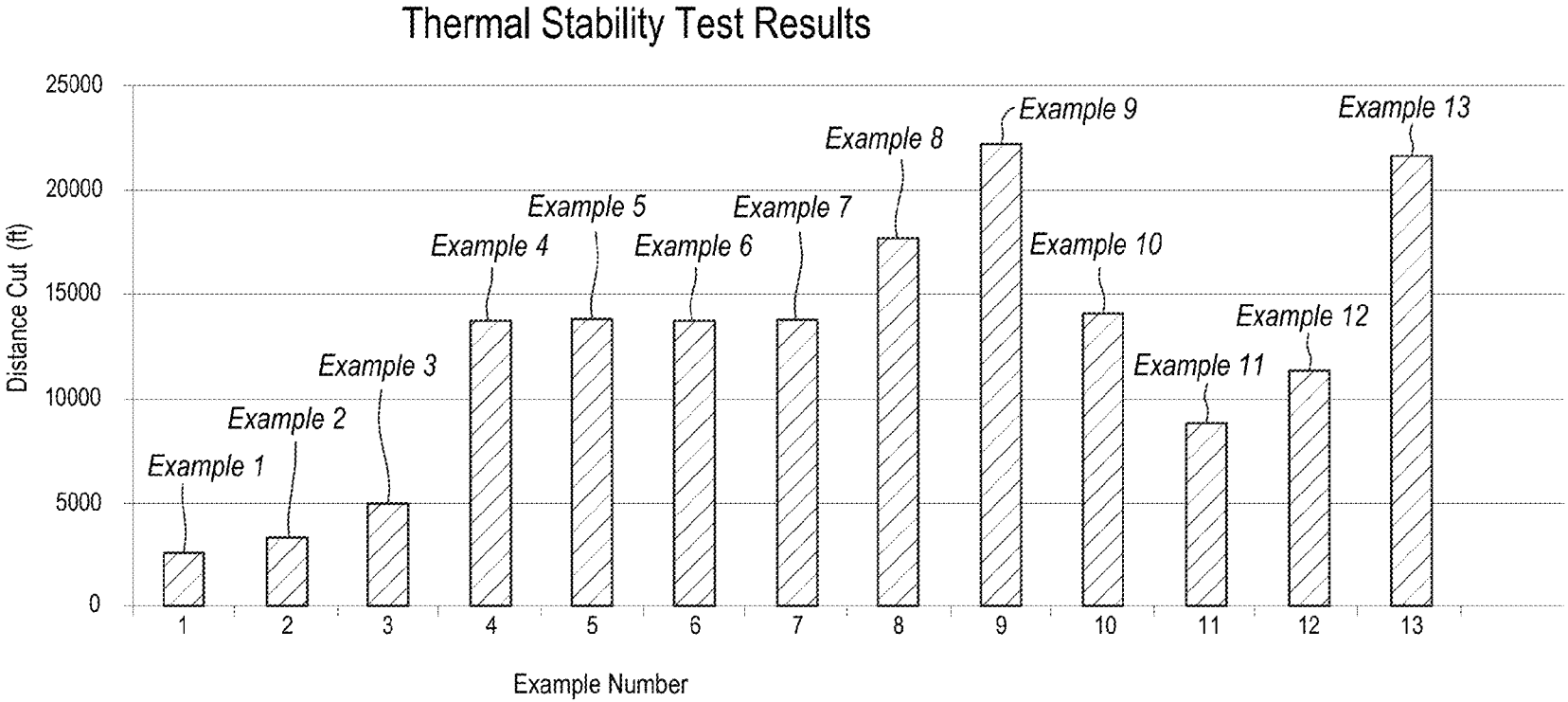
FIG. 11 is a bar chart showing the distance cut prior to failure for the PDCs of working examples 1-13.

FIG. 11 is a bar chart showing the distance cut prior to failure for all of the working examples. The thermal stability of the copper-infiltrated PCD tables of examples 4 and 5 was evaluated by measuring the distance cut in the same workpiece used to test comparative examples 1-3 and using the same test parameters, without using coolant, in a vertical turret lathe test. The copper-infiltrated PCD tables of the PDCs of examples 4 and 5 were able to cut a distance about 13706 and 13758 linear feet, respectively, in the workpiece, which was greater than the distance that the un-leached and leached PDCs of comparative examples 1-3 were able to cut. The thermal stability tests were stopped before the copper-infiltrated PCD tables of the PDCs of examples 4 and 5 failed.

Figure 12:
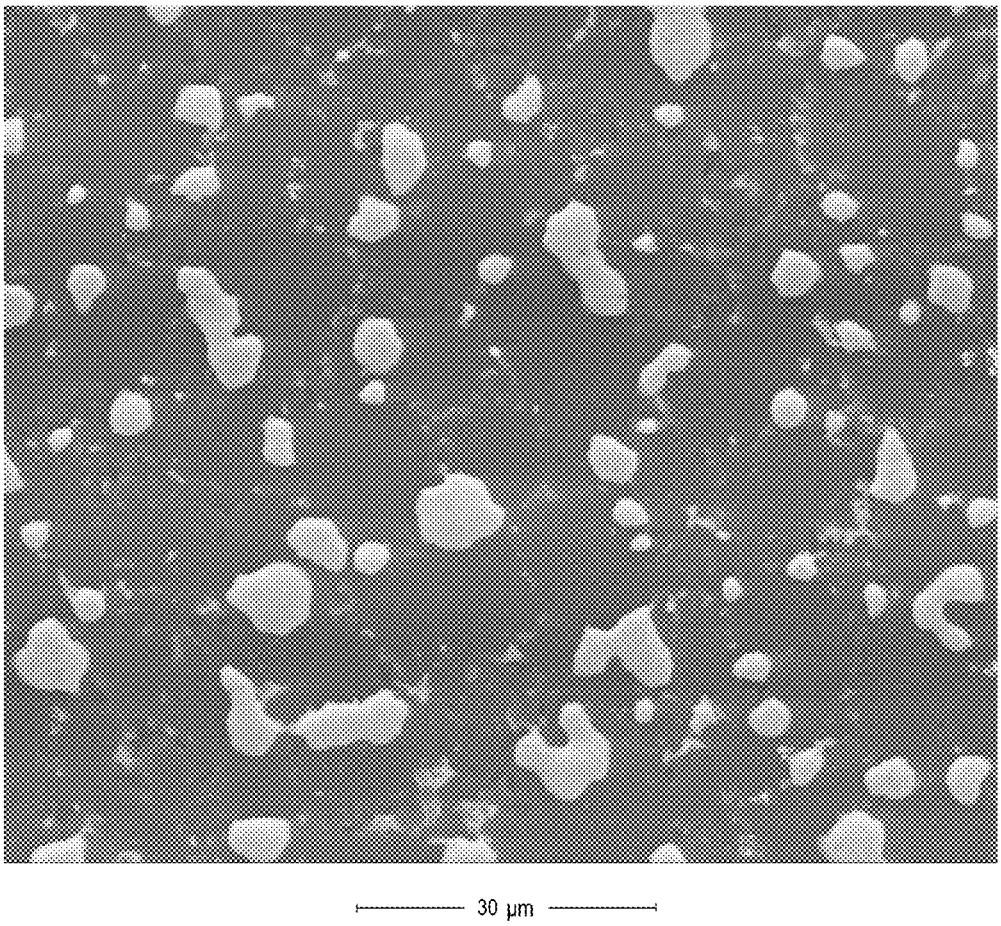
FIG. 12 is a scanning electron photomicrograph showing copper (light regions) being extruded out of a copper-infiltrated PCD table fabricated in accordance with working examples 4 and 5 during heating.

Scanning electron microscopy was performed on a PDC fabricated in accordance with examples 4 and 5, while the PDC was heated to a temperature of about 1338° C. FIG. 12 is a scanning electron photomicrograph showing the copper infiltrant (light regions) being extruded out of an upper surface of the copper-infiltrated PCD table and from between the diamond grains (dark regions) of the copper-infiltrated PCD table during heating at a temperature of about 1338° C. No evidence of any cracking of the copper-infiltrated PCD table was observed during the scanning electron microscopy.

Examples 6 and 7

Two PDCs were fabricated as performed in examples 4 and 5. The nominal thickness of the PCD tables of the PDCs were about 2.286 mm and an about 45 degree, 0.3048-mm nominal chamfer was machined in the PCD tables. Then, the PCD tables were acid leached after machining to remove at least some of the copper from the copper-infiltrated PCD tables.

The thermal stability of the leached copper-infiltrated PCD tables of examples 6 and 7 was evaluated by measuring the distance cut in the same workpiece used to test comparative examples 1-5 and using the same test parameters, without using coolant, in a vertical turret lathe test. As shown in FIG. 11, the leached copper-infiltrated PCD tables of the PDCs of examples 6 and 7 were able to cut a distance about 13731 and 13690 linear feet, respectively, in the workpiece, which was greater than the distance that the un-leached and leached PDCs of comparative examples 1-3 were able to cut. The thermal stability tests were stopped before the leached copper-infiltrated PCD tables of the PDCs of examples 6 and 7 failed.

Examples 8 Through 10

Three PDCs were fabricated as performed in examples 4 and 5 except a layer of tin was employed instead of a layer of copper to infiltrate an upper region of the at least partially leached PCD tables. The nominal thickness of the PCD tables of the PDCs were about 2.286 mm and an about 45 degree, 0.3048-mm nominal chamfer was machined in the PCD tables.

The thermal stability of the copper-infiltrated PCD tables of examples 8-10 was evaluated by measuring the distance cut in the same workpiece used to test comparative examples 1-7 and using the same test parameters, without using coolant, in a vertical turret lathe test. As shown in FIG. 11, the tin-infiltrated PCD tables of the PDCs of examples 8-10 were able to cut a distance of about 17662, 22154, and 14048 linear feet, respectively, in the workpiece prior to failure, which was greater than the distance that the un-leached and leached PDCs of comparative examples 1-3 were able to cut.

Examples 11 Through 13

Three PDCs were fabricated as performed in examples 4 and 5 except a layer of aluminum was employed instead of a layer of copper to infiltrate an upper region of the at least partially leached PCD tables. The nominal thickness of the PCD tables of the PDCs were about 2.286 mm and an about 45 degree, 0.3048-mm nominal chamfer was machined in the PCD tables.

The thermal stability of the aluminum-infiltrated PCD tables of examples 11-13 was evaluated by measuring the distance cut in the same workpiece used to test comparative examples 1-10 and using the same test parameters, without using coolant, in a vertical turret lathe test. As shown in FIG. 11, the aluminum-infiltrated PCD tables of the PDCs of examples 11-13 were able to cut a distance of about 8850, 11372, and 21628 linear feet, respectively, in the workpiece prior to failure, which was greater than the distance that the un-leached and leached PDCs of comparative examples 1-3 were able to cut.

While various aspects and embodiments have been disclosed herein, other aspects and embodiments are contemplated. The various aspects and embodiments disclosed herein are for purposes of illustration and are not intended to be limiting. Additionally, the words "including," "having," and variants thereof (e.g., "includes" and "has") as used herein, including the claims, shall be open ended and have the same meaning as the word "comprising" and variants thereof (e.g., "comprise" and "comprises").

What is claimed is:

1. A polycrystalline diamond compact, comprising:

a substrate; and a polycrystalline diamond table including a plurality of diamond grains exhibiting diamond-to-diamond bonding therebetween and defining a plurality of interstitial regions, the polycrystalline diamond table further including a working surface spaced from an interfacial surface that is bonded to the substrate, the polycrystalline diamond table additionally including:

a first region extending inwardly from the working surface, the first region including at least one low-carbon-solubility material disposed in at least a portion of the plurality of interstitial regions thereof, the at least one low-carbon-solubility material exhibiting a melting temperature of about 1300° C. or less and a bulk modulus at 20° C. of less than about 150 GPa; and a second region extending inwardly from the interfacial surface, the second region including a metallic constituent disposed in at least a portion of the plurality of interstitial regions thereof;

wherein the first region exhibits a generally ring-like geometry encircling a portion of the second region and is spaced from the interfacial surface by a portion of the second region.

2. The polycrystalline diamond compact of claim 1 wherein the at least one low-carbon-solubility material exhibits a melting temperature of less than about 1200° C. and a bulk modulus at 20° C. of less than about 140 GPa.

3. The polycrystalline diamond compact of claim 1 wherein the at least one low-carbon-solubility material exhibits a coefficient of thermal expansion of about $3\times10^{-6}$ per ° C. to about $20\times10^{-6}$ per ° C., a melting temperature of about 180° C. to about 1100° C., and a bulk modulus at 20° C. of about 30 GPa to about 150 GPa.

4. The polycrystalline diamond compact of claim 1 wherein the at least one low-carbon-solubility material exhibits a coefficient of thermal expansion of about $15\times10^{-6}$ per ° C. to about $20\times10^{-6}$ per ° C., a melting temperature of about 950° C. to about 1100° C., and a bulk modulus at 20° C. of about 120 GPa to about 140 GPa.

5. The polycrystalline diamond compact of claim 1 wherein the at least one low-carbon-solubility material exhibits a coefficient of thermal expansion of about $15\times10^{-6}$ per ° C. to about $20\times10^{-6}$ per ° C. a melting temperature of about 180° C. to about 300° C., and a bulk modulus at 20° C. of about 45 GPa to about 55 GPa.

6. The polycrystalline diamond compact of claim 1 wherein the at least one low-carbon-solubility material comprises at least one member selected from the group consisting of copper, tin, indium, gadolinium, germanium, gold, silver, aluminum, lead, zinc, cadmium, bismuth, and antimony.

7. The polycrystalline diamond compact of claim 1 wherein the at least one low-carbon-solubility material comprises at least one member selected from the group consisting of copper, tin, indium, and aluminum.

8. The polycrystalline diamond compact of claim 1 wherein the at least one low-carbon-solubility material comprises a metallic, non-ceramic material.

9. The polycrystalline diamond compact of claim 1 wherein the diamond-to-diamond bonding between the diamond grains of the polycrystalline diamond table is sufficiently strong so that the at least one low-carbon-solubility material extrudes out of a working surface of the polycrystalline diamond table during heating thereof at a temperature of at least about 0.6 times the melting temperature of the at least one low-carbon-solubility material, measured in absolute temperature, without fracturing the polycrystalline diamond table.

10. The polycrystalline diamond compact of claim 1 wherein the at least one low-carbon-solubility material is infiltrated into the polycrystalline diamond table from the working surface thereof to no further than an intermediate location therewithin.

11. The polycrystalline diamond compact of claim 1 wherein the first region of the polycrystalline diamond table comprises a metallic constituent in a residual amount, wherein the metallic constituent includes a metal-solvent catalyst.

12. The polycrystalline diamond compact of claim 1 wherein the first region extends from an upper surface of the polycrystalline diamond table to an intermediate depth of about 0.20 mm to about 1.5 mm.

13. The polycrystalline diamond compact of claim 12 wherein the intermediate depth is about 0.65 mm to about 0.90 mm.

14. The polycrystalline diamond compact of claim 1 wherein the at least one low-carbon-solubility material occupies all of the interstitial regions of the first region.

15. The polycrystalline diamond compact of claim 1 wherein the substrate comprises a cemented carbide substrate.

16. The polycrystalline diamond compact of claim 1 wherein the polycrystalline diamond table is integrally formed with the substrate.

17. The polycrystalline diamond compact of claim 1 wherein the metallic constituent comprises at least one member selected from the group consisting of iron, nickel, cobalt, and alloys thereof.

18. The polycrystalline diamond compact of claim 1 wherein the metallic constituent comprises a metallic catalyst.

19. The polycrystalline diamond compact of claim 1 wherein the polycrystalline diamond table comprises a leached region exhibiting a residual amount of the at least low-carbon-solubility material of about 0.8 weight percent to about 1.5 weight percent of the leached region.

20. The polycrystalline diamond compact of claim 19 wherein the residual amount is about 1.5 weight percent of the leached region.

21. The polycrystalline diamond compact of claim 1 wherein the at least one low-carbon-solubility material comprises copper.

22. The polycrystalline diamond compact of claim 1 wherein the at least one low-carbon-solubility material comprises a copper alloy.

23. A polycrystalline diamond compact, comprising:

a substrate; and a polycrystalline diamond table bonded to the substrate, the polycrystalline diamond table including a plurality of diamond grains exhibiting diamond-to-diamond bonding therebetween and defining a plurality of interstitial regions, the polycrystalline diamond table including a working surface spaced from an interfacial surface, the polycrystalline diamond table additionally including;

a first region extending inwardly from the working surface, the first region including at least one low-carbon-solubility material and a residual amount of metal-solvent catalyst disposed in a first portion of the plurality of interstitial regions, the at least one low-carbon-solubility material including at least one member selected from the group consisting of copper, tin, indium, and aluminum, the at least one low-carbon-solubility material exhibiting a melting temperature of about 1300° C. or less;

a second region extending inwardly from the interfacial surface bonded to the substrate at the interfacial surface and including a metallic constituent disposed in a second portion of the plurality of interstitial regions;

wherein the first region exhibits a generally ring-like geometry encircling a portion of the second region and is spaced from the interfacial surface by a portion of the second region; and wherein the diamond-to-diamond bonding between the diamond grains of the polycrystalline diamond table is sufficiently strong so that the at least one low-carbon-solubility material extrudes out of the working surface during heating thereof at a temperature of at least about 0.6 times the melting temperature of the at least one low-carbon-solubility material, measured in absolute temperature, without fracturing the polycrystalline diamond table.

24. The polycrystalline diamond compact of claim 23 wherein the first region includes a residual amount of the at least one low-carbon-solubility material of about 0.8 weight percent to about 1.5 weight percent of the first region.

25. The polycrystalline diamond compact of claim 23 wherein the first region comprises a leached region including a residual amount of the at least one low-carbon-solubility material of about 0.8 weight percent to about 1.5 weight percent of the first region of the polycrystalline diamond table and the residual amount of the metallic constituent up to 2.0 weight percent of the first region of the polycrystalline diamond table.

26. The polycrystalline diamond compact of claim 23 wherein the at least one member is copper.

27. The polycrystalline diamond compact of claim 23 wherein the substrate includes the metallic constituent therein, and wherein the metallic constituent in the second region of the polycrystalline diamond table is provided from the substrate.

28. The polycrystalline diamond compact of claim 23 wherein the substrate comprises a cobalt-cemented tungsten carbide substrate including the metallic constituent as a cementing constituent therein, wherein the metallic constituent comprises cobalt, and wherein the metallic constituent in the second region of the polycrystalline diamond table is provided from the substrate.

* * * * *